US007090969B1

(12) United States Patent
Mura et al.

(10) Patent No.: US 7,090,969 B1
(45) Date of Patent: Aug. 15, 2006

(54) COUPLER AND IMAGE DYE LIGHT-STABILIZING SYSTEMS

(75) Inventors: Albert J. Mura, Rochester, NY (US); Shari L. Eiff, Rush, NY (US); Gary M. Russo, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 70 days.

(21) Appl. No.: 11/080,086

(22) Filed: Mar. 15, 2005

(51) Int. Cl.
*G03C 1/08* (2006.01)
*G03C 7/26* (2006.01)
*G03C 7/32* (2006.01)
*G03C 1/46* (2006.01)

(52) U.S. Cl. ..... 430/551; 430/502; 430/503; 430/543; 430/556; 430/557; 430/558; 430/552; 430/553; 430/931; 430/607

(58) Field of Classification Search ..... 430/502, 430/503, 543, 551, 556, 557, 558, 552, 553, 430/931, 607
See application file for complete search history.

(56) References Cited

U.S. PATENT DOCUMENTS 3,705,805 A 12/1972 Nittel et al.
3,707,375 A 12/1972 Ohi et al.
4,268,593 A 5/1981 Leppard et al.
4,584,265 A 4/1986 Leppard et al.
6,140,031 A 10/2000 Cowan et al.

*Primary Examiner*—Geraldine Letscher
(74) *Attorney, Agent, or Firm*—Arthur E. Kluegel

(57) ABSTRACT

A photographic element comprises a silver halide emulsion layer having associated therewith a dye forming coupler and a compound of the following Formula I1:

(I1)

wherein
L is a linking moiety;
X is a heteroatom group selected from O, S, or NR' where R' is H or a substituent;
w is 0 or 1;
R is hydrogen or a substituent group;
n is an integer from 0 to 5; and
ST represents a stabilizer selected from the group consisting of:
A. a thiomorpholine dioxide;
B. a dialkoxy aromatic group linked through a phenolic oxygen;
C. a dialkoxy aromatic group linked through the aromatic ring;
D. a sulfonamido group;
E. a hydroxyphenyl benzotriazole group; and
F. a phenolic group.

21 Claims, No Drawings

COUPLER AND IMAGE DYE LIGHT-STABILIZING SYSTEMS

FIELD OF INVENTION

This invention relates to silver halide color photographic materials. More particularly, it relates to color photographic materials, which contain dye-forming couplers together in conjunction with non-imaging compounds, which function as unique light stabilizers. These compounds are a combination of certain classes of light stabilizers chemically linked to cinnamate energy-dissipating groups; the combination of which give rise to photographic images providing a synergistic level of stability towards light fading.

BACKGROUND OF THE INVENTION

In a silver halide photographic element, a color image is formed when the element is exposed to light and then subjected to color development with a primary aromatic amine developer. Color development results in image wise reduction of silver halide and production of oxidized developer. Oxidized developer reacts with one or more incorporated dye-forming couplers to form an image wise distribution of dye. Dye-forming couplers (as well as other various photographic addenda) are typically dispersed in silver halide emulsion layers of the photographic element with the aid of coupler solvents, which are typically oily or low melting compounds.

In any polychromatic chromogenic photographic material, it is desirable that the dyes so formed should have certain properties. For instance, the dyes should be bright in color with very little secondary absorption so that good color reproducibility is obtained. The stability of image dyes generated on chromogenic development often does not meet performance expectations. These expectations include resistance to light fade and both humid and dry heat dark fade. The dyes that are formed by any color coupler during processing have a tendency to fade over time as a result of exposure to light, heat, humidity and oxygen resulting in a deterioration of the original recorded image. It is therefore highly desirable that the formed dyes should be resistant towards fading by heat, humidity and light.

Techniques are known in the art for providing resistance to light fade of photographic dyes. Unfortunately, these techniques have not been completely successful resulting in the development of many unique stabilizing chemistries. Compounds which have been disclosed as light stabilizers image dyes, e.g., include substituted phenolic and blocked phenolic compounds including; heterocyclic phosphorous materials (U.S. Pat. No. 4,749,645), substituted and blocked bisphenols (UK 1,267,287, U.S. Pat. No. 4,782,011, DE 4,307,439, DE 4,307,439, DE 4,320,828, EP 0 508 398, EP 0 538 862, U.S. Pat. No. 5,294,530, U.S. Pat. No. 5,426,021, U.S. Pat. No. 5,441,855, U.S. Pat. No. 5,441,861, U.S. Pat. No. 5,466,569, U.S. Pat. No. 5,891,613, WO 91/008,515, U.S. Pat. No. 5,567,578, U.S. Pat. Nos. 5,284,742, 5,091, 294, EP 0 310 552, U.S. Pat. No. 5,935,773). In addition, dyes may also be stabilized against fading by light with the use of aromatic thiomorpholine dioxide compounds as described in EP 1 116 99, U.S. Pat. No. 5,561,037, EP 457,543, EP 310,552, EP 310,551, EP 397,050, EP 393,718, U.S. Pat. No. 5,360,711; and various sulfonamido compounds (U.S. Pat. No. 6,140,031, U.S. Pat. No. 6,071,686, U.S. Pat. No. 6,013,429). German patent application DE 1 96 32927 describes the use of cyclic imides, cyclic carbamates, and cyclic ureas as a means of improving the chromogenically developed color image dye stabilities. However, in particular, the amount of dye stabilization to light fade is only modest. U.S. Pat. No. 5,352,572 reports the use of a specific bis-urea compound in combination with malonamide yellow couplers. However, the bis-urea was not shown to be effective for other couplers and was specifically reported to be ineffective for beta-ketoamide yellow couplers. U.S. Pat. No. 6,045,987 describes the use of amide group substituted aromatic compounds, wherein the amide groups are directly bonded to a phenyl ring, as addenda to coupler dispersions, and in particular the use of such compounds in association with magenta and cyan dye image-forming couplers. U.S. Pat. No. 6,413,707 discloses the use of urethane compounds and U.S. Pat. No. 6,555,306 describes the utilization of a substituted dipiperidine compound as coupler solvents in photographic elements to improve image dye stability. Most recently aliphatic bis-amide compounds have been patented as light stabilizing yellow coupler solvents (U.S. Pat. No. 6,846,620).

Various stabilizers classes have been chemically bonded together to form combination stabilizers. For example, thiomorpholine dioxide stabilizers have been linked to sulfonamido stabilizers (U.S. Pat. No. 6,140,031) and phenolic stabilizers have been bonded to Hindered Amine Light Stabilizers (U.S. Pat. No. 4,584,265).

It is still desirable to improve on the light stabilization of dyes beyond that afforded with use of the above stabilizers. $R_a$ rely mentioned is the lifetime of an individual stabilizer itself. Theoretically if the stabilizer is consumed during the process, at some point the system will fail due to lack of stabilizer. For example, hindered phenolic antioxidant have a turn over number of four at their greatest [Ohkatsu, Y., Matsuura, T., and Yamato, M.; *Polym. Degrad. And Stab.*, (2003), 81, 151–156]. This means a phenolic stabilizer will only go through the stabilizing process a maximum of four times before it is consumed. It would be advantageous to have a method to increase the lifetime of the stabilizer, the result of which would lead to an increase in the lifetime of the dye imaging system.

Energy dissipation is a well-known mechanism of action in certain compounds capable of protecting molecules against decomposition by light, such as ultraviolet light absorbers (UVA's). They absorb unwanted UV energy and then dissipate this energy via heat release or other harmless mechanisms to return the excited molecule back to its ground state. Cinnamates are one class of UV absorber utilized in many commercial sun block cosmetics. For example, ethylhexyl-p-methoxy cinnamate, Parsol MCX (CAS 5466-77-3), is one most commonly utilized. Cinnamates are known to dissipate energy through an efficient reversible cis/trans photoisomerization reaction. The E to Z and Z to E isomerization is not far from unity. Cinnamates have been patented as UV absorbers for photographic uses (U.S. Pat. Nos. 3,705,805; 3,707,375).

In spite of the above attempts to improve dye stability, further improvements are still needed to stabilize image dyes against light exposure.

SUMMARY OF THE INVENTION

The invention provides a photographic element comprising a silver halide emulsion layer having associated therewith a dye forming coupler and a compound of the following Formula I1:

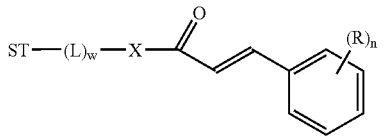

(I1)

wherein

L is a linking moiety;

X is a heteroatom group selected from O, S, or NR' where R' is H or a substituent;

w is 0 or 1;

R is hydrogen or a substituent group;

n is an integer from 0 to 5; and

ST represents a stabilizer selected from the group consisting of:

A. a thiomorpholine dioxide group;

B. a dialkoxy aromatic group linked through a phenolic oxygen;

C. a dialkoxy aromatic group linked through the aromatic ring;

D. a sulfonamido group;

E. a hydroxyphenyl benzotriazole group; and

F. a phenolic group.

When image dye layers contain the stabilizer useful in the invention, an improvement in dye light stability is obtained.

DETAILED DESCRIPTION OF THE INVENTION

The invention is generally as described above.

The photographic elements of this invention can be chromogenic black and white elements (for example, using yellow, magenta and cyan dye forming couplers), single color elements or multicolor elements. In accordance with preferred embodiments of the invention, the photographic elements comprise at least one yellow dye image forming layer, at least one cyan dye image-forming layer and at least one magenta dye image-forming layer. More particularly, multicolor photographic elements in accordance with preferred embodiments of the invention preferably comprise a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion hydrophilic colloid layer units sensitized to the red, green and blue regions of the spectrum. Each unit can comprise a single emulsion layer or multiple emulsion layers sensitive to a given region of the spectrum. The layers of the element, including the layers of the image forming units, can be arranged in various orders as known in the art. It is within the scope of this invention, however, for the light sensitive material to alternatively or additionally be sensitive to one or more regions of the electromagnetic spectrum outside the visible, such as the infrared region of the spectrum. In most color photographic systems, non-diffusing color-forming couplers are incorporated in the light-sensitive photographic emulsion layers so that during development, they are available in the emulsion layer to react with the color-developing agent that is oxidized by silver halide image development. When the dye image formed is to be used in situ, couplers are selected which form non-diffusing dyes. Color photographic systems can also be used to produce black-and-white images from non-diffusing couplers as described, e.g., by Edwards, et al., in International Publication No. WO 93/012465.

Unless otherwise specifically stated, use of the term "substituted" or "substituent" means any group or atom other than hydrogen. Unless otherwise provided, when a group, compound or formula containing a substitutable hydrogen is referred to, it is also intended to encompass not only the unsubstituted form, but also form further substituted with any substituent group or groups as herein mentioned, so long as the substituent does not destroy properties necessary for utility. Suitably, a substituent group may be halogen or may be bonded to the remainder of the molecule by an atom of carbon, silicon, oxygen, nitrogen, phosphorous, or sulfur. The substituent may be, for example, halogen, such as chloro, bromo or fluoro; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, cyclohexyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl] sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired desirable properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

Examples of the more commonly employed substituents include: halogen, for example, chloro, fluoro, bromo, iodo; alkoxy, particularly those with 1 to 6 carbon atoms (for example, methoxy, ethoxy); substituted or unsubstituted alkyl, particularly lower alkyl, for example, methyl, trifluoromethyl; alkenyl, for example, propenyl; thioalkyl, for example, methylthio or ethylthio, particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl). Alkyl substituents may specifically include "lower alkyl", that is having from 1 to 6 carbon atoms, for example, methyl, ethyl, cyclohexyl, and the like. "Higher alkyl," sometimes referred to as "ballasts" required for the above-mentioned non-diffusing dyes, typically have 7–40 carbon atoms. Further, with regard to any alkyl group, alkylene group or alkenyl group, it will be understood that these can be branched or unbranched and include ring structures.

In Formula (I1), R is any substituent group as defined above, for example, alkyl, alkenyl, aryl, alkoxy, aryloxy, alkylamino, arylamino, akylthio, arylthio, halo, or sulfonamido, and X is a heteroatom group, selected from O, S, or NR' where R' is any substituent group as selectable for R.

In accordance with the invention, compounds of Formula I1 are utilized to improve the light stability of dye images formed from photographic couplers. Formula I1, containing specific conventional stabilizers, can be as shown in Formulas A–F below:

(A)

Formula A (containing thiormorpholine dioxide group):

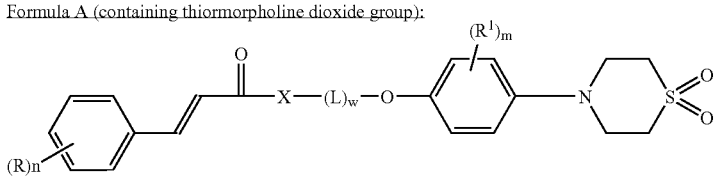

wherein R, n, X, L, and w are as defined for formula I1; $R^1$ is a substituent as defined above, for example, alkyl, alkenyl, aryl, alkoxy, aryloxy, alkylamino, arylamino, akylthio, arylthio, halo, or sulfonamido; n is an integer between 0 and 5; m is an integer between 0 and 4. If n and m are 2 through 4 the R groups may be the same or different. Two R or two $R^1$ groups may form a substituted or unsubstituted ring. L is any molecular group that would chemically link the two parts, stabilizer and cinnamate. Representative examples of hydrocarbon linking groups include: $C_1$–$C_{30}$ alkylene, tetramethylhexane, cylcohexane, cyclohexane diethyl, dioxaoctane, p-phenylene-di-propane, and the like. Hydrocarbon linking groups represented by L may be further substituted or unsubstituted, with aromatic or nonaromatic substituents. L can also be substituted and unsubstituted aromatic ring systems. L may additionally contain a second cinnamate moiety, a second thiomorpholine dioxide stabilizer, or a stabilizer of a different structure as show in the formula below:

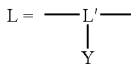

wherein Y is represented by a formula selected from:

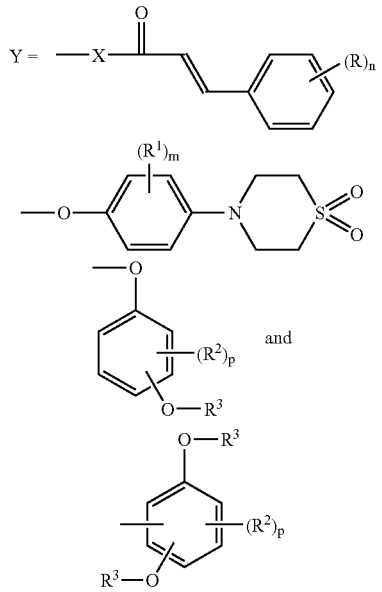

wherein L', like L, is any molecular group that would chemically link the various parts of the molecule; $R^2$ thru $R^4$ are substituents as for $R^1$; w can be either 0 or 1; and p is an integer from 0 to 4.

(B)

Formula B (containing a dialkoxyaromatic group):

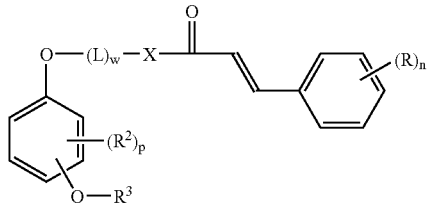

wherein R, n, X, L, and w are as defined for formula 11;

$R^2$ and $R^3$ are substituents defined above or two R groups or one $R^2$ and one $R^3$ together may form a substituted or unsubstituted ring. Specifically, $R^2$ and $R^3$ may also together or separately be taken from —L—ST or —L—X—ED; p is an integer from 0 to 4. If p is 2 or larger, the respective R groups may be the same or different.

(C)

Formula C (containing a dialkoxyaromatic group):

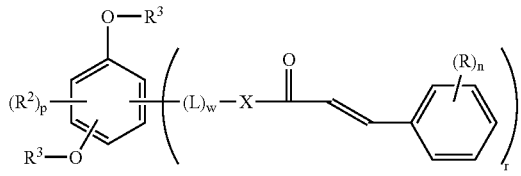

wherein R, n, X, L, w and $R^2$ and $R^3$ are as defined for formula (B);

p is an integer from 0 to 3, r is an integer from 1 to 4, provided the total of p and r is no larger than 4.

(D)

Formula D (containing a sulfonamide group):

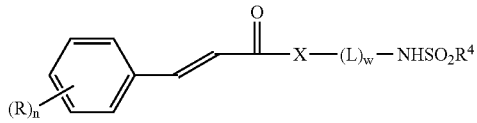

wherein R, n, X, L, and w are as defined for formula (I1); and $R^4$ is a substituted or unsubstituted alkyl or cycloalkyl group, for example, methyl, ethyl, butyl, hexyl, octyl, decyl, dodecyl, 2-ethylhexyl, benzyl, cyclohexyl, or cyclopentyl; or a substituted or unsubstituted aryl or heteroaryl group, such as phenyl, methoxyphenyl, methylphenyl, pyridyl, or furyl.

(E)

Formula E (containing a hydroxyphenyl benzotriazole group):

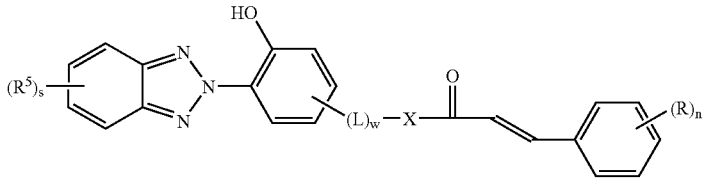

wherein

R, n, X, L, and w are as defined for formula (I1);

$R^5$ is a substituent as defined above, such as chloro, bromo, fluoro, methyl, ethyl, isopentyl, 2-ethylhexyl, carboxylmethyl, sulfonamido, methoxy, isopropoxy, amino, carbamoyl, methylcarboxamido, methylsulfonyl, trifluoromethyl, carboxy or phenyl; and s is an integer between 0 and 4;

provided that if s is 2 through 4, the $R^5$ groups may be the same or different. Two $R^5$ groups together may form a substituted or unsubstituted ring.

Formula F (containing a phenolic group):

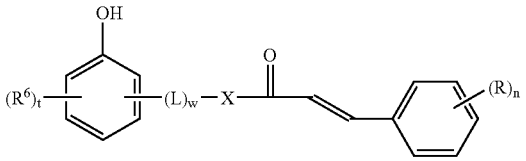

wherein

R, n, X, L, and w are as defined for formula (I1);

$R^6$ is a substituent as defined above including an —L—ST or —L—X—ED group;

t is an integer between 0 and 4; provided that if t is 2 through 4, the $R^6$ groups may be the same or different and provided that two $R^6$ groups together may form a substituted or unsubstituted ring.

Compounds of Formula I1 in accordance with the present invention may be prepared according to synthetic methods known in the art. Specific examples of compounds of Formula I1 include, but are not limited to, the following:

Ia

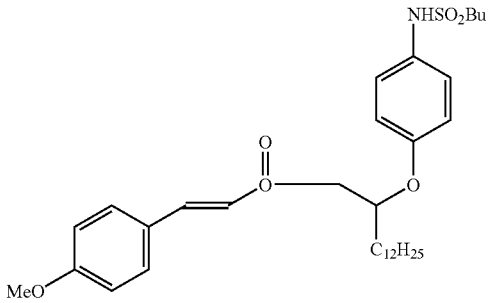

Ib

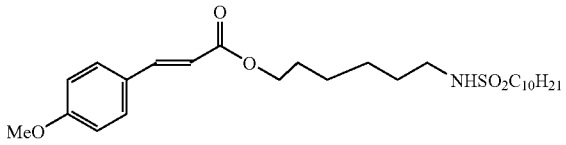

Ic

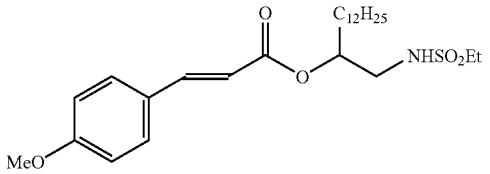

Id

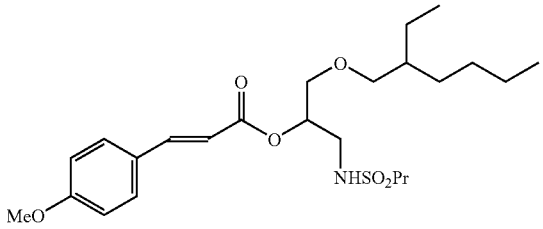

Ie

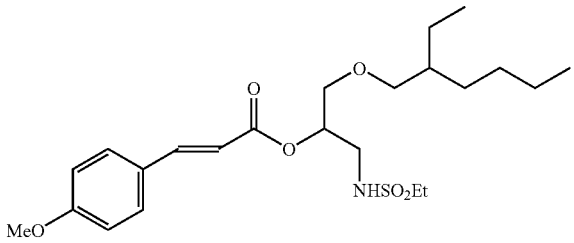

If

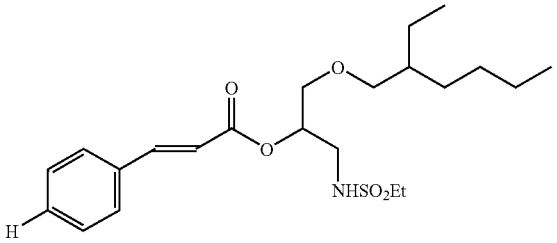

-continued
Ig
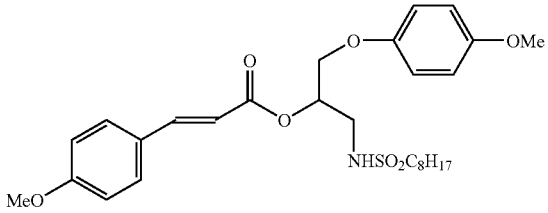
Ih
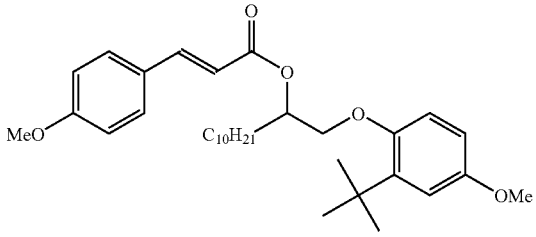
Ii
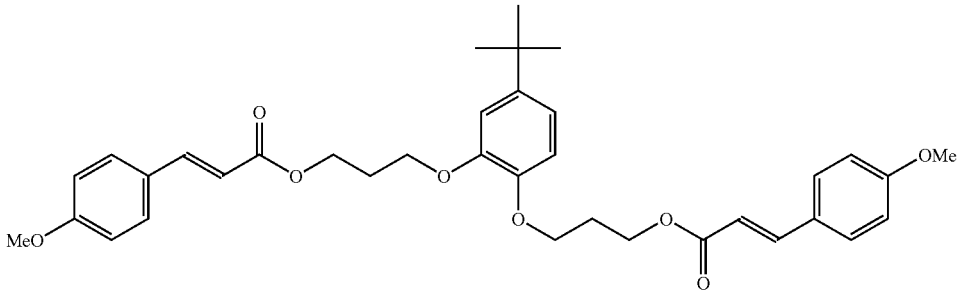
Ij
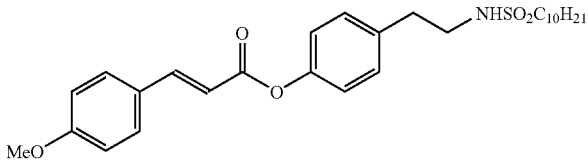
Ik
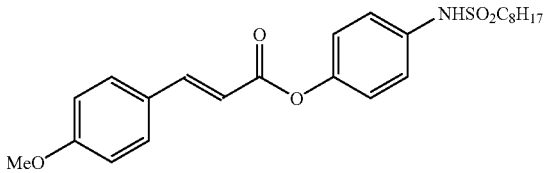
Il
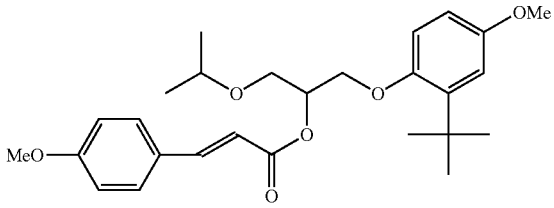
Im
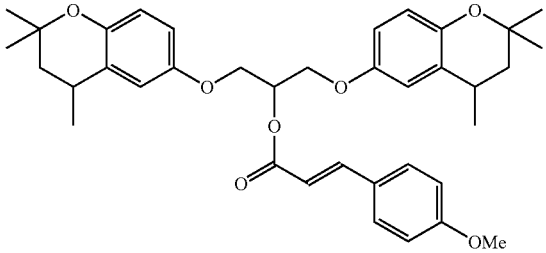
In
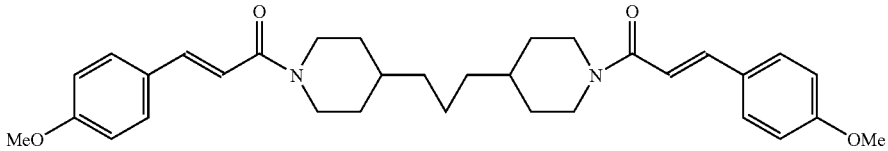
Io
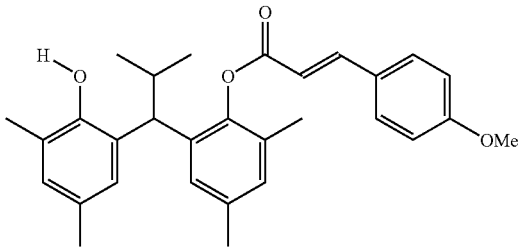
Ip
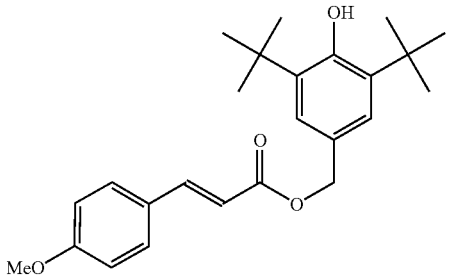

-continued
Iq
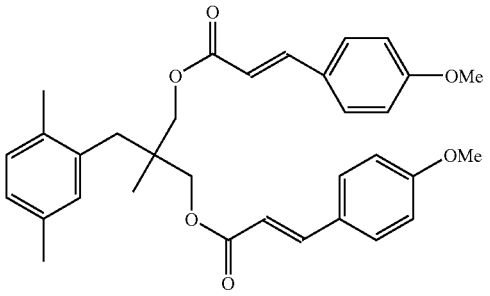
Ir
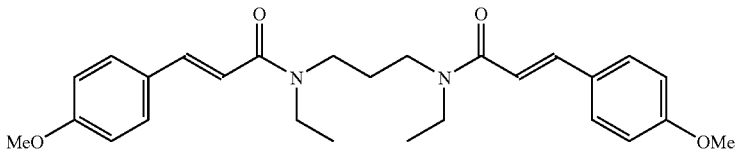
Is
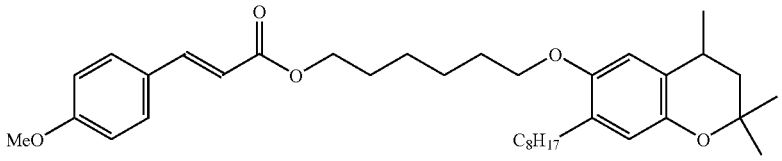
It
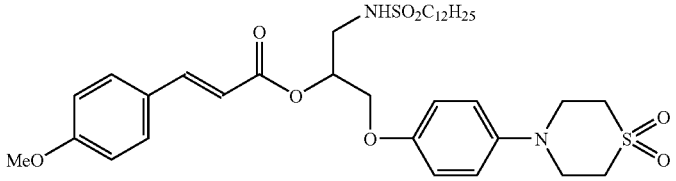
Iu
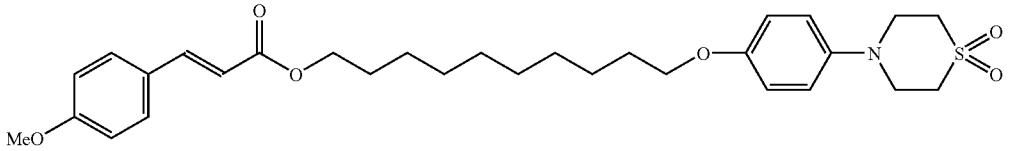
Iv
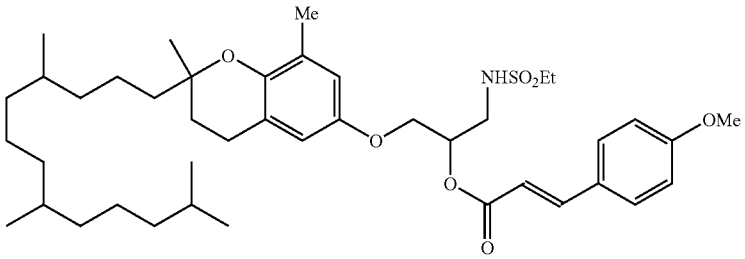
Iw
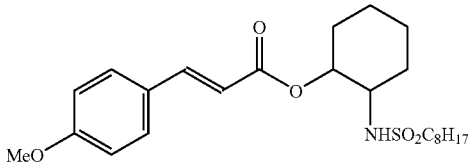

-continued
Ix
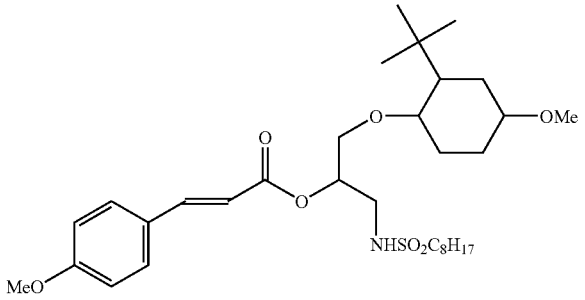
Iy
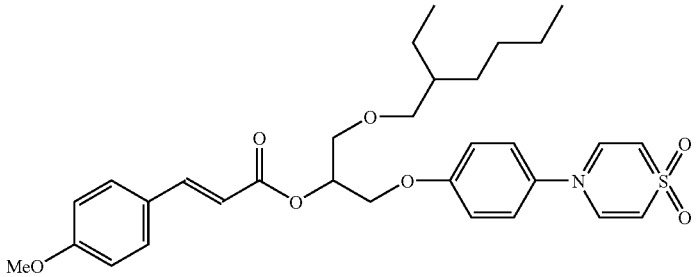
Iz
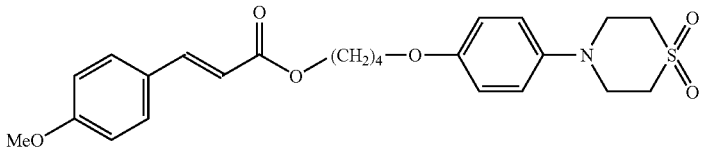
Iaa
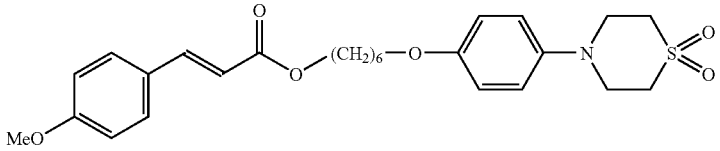
Ibb
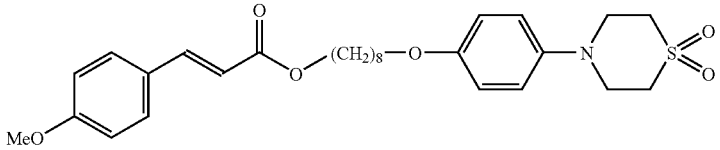
Icc
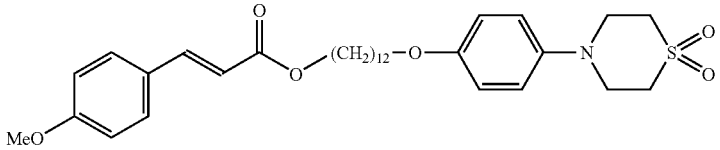
Idd
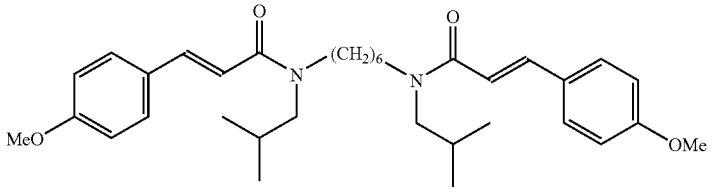

-continued
Iee
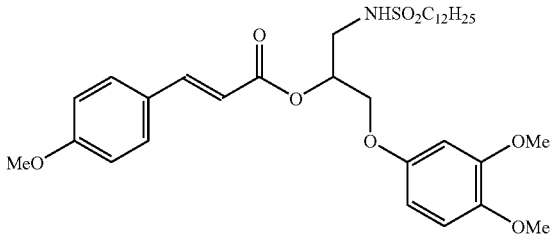
Iff
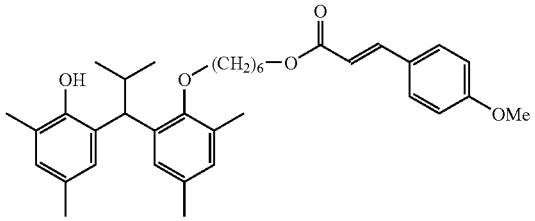
Igg
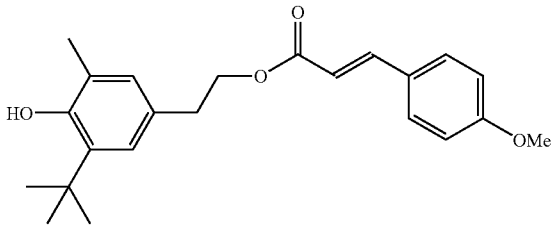
Ihh
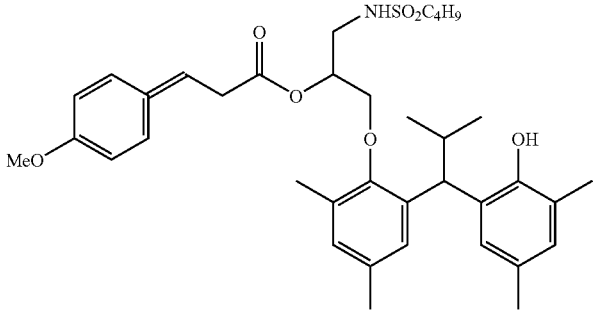
Iii
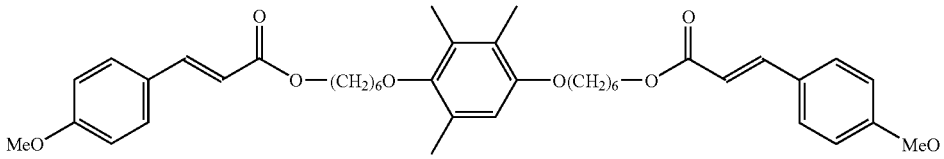
Ijj
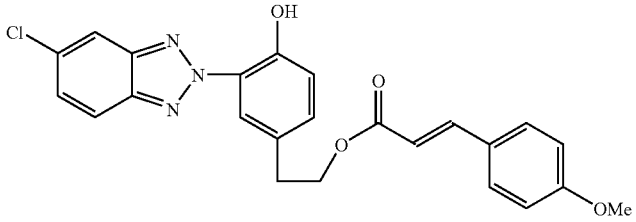
Ikk
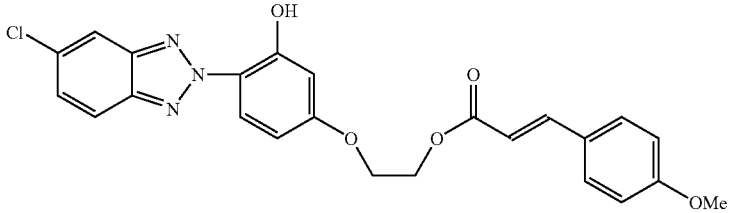

-continued
Ill
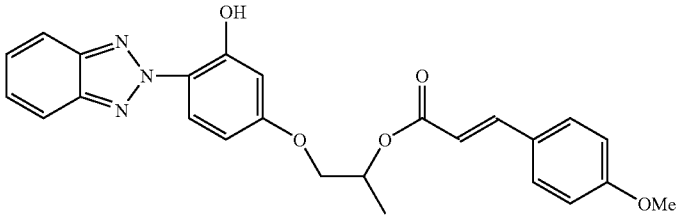
Imm
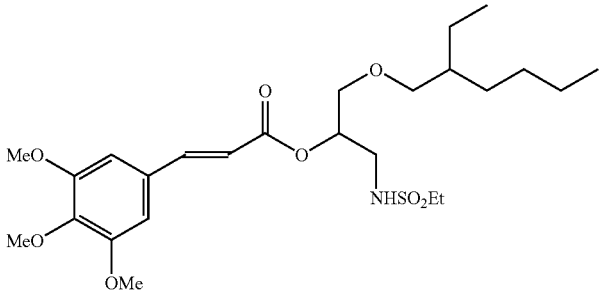
Inn
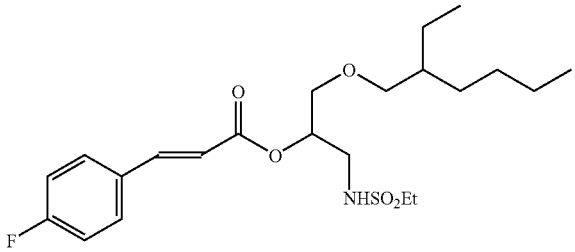
Ioo
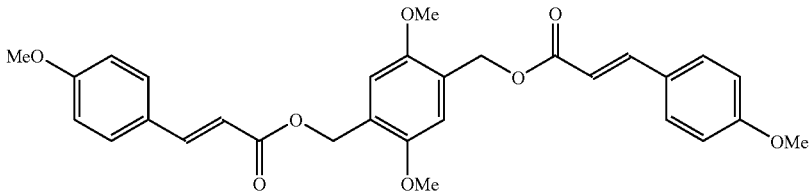
Ipp
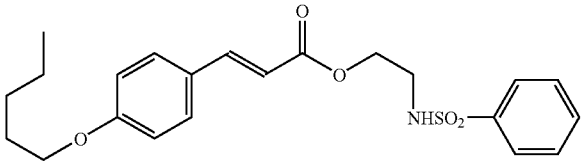
Iqq
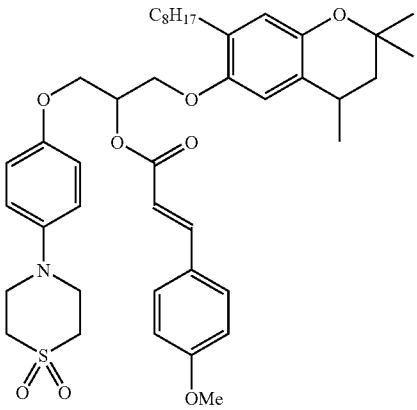
Irr
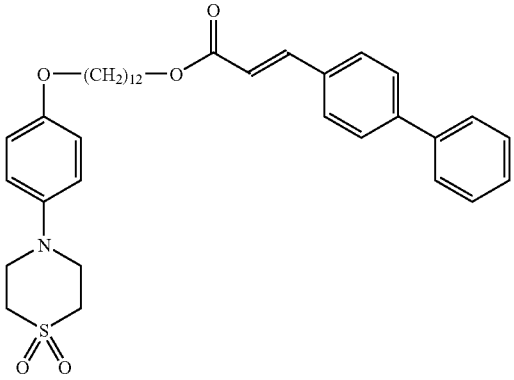

-continued

Iss

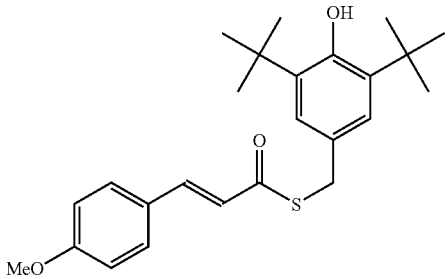

Itt

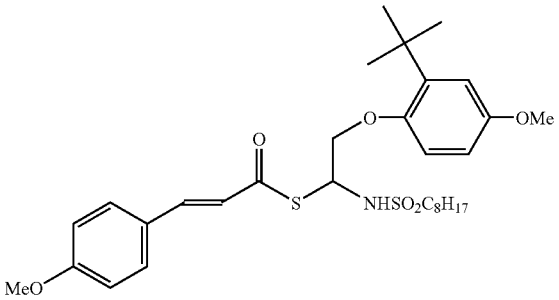

In accordance with a preferred embodiment of the present invention, the compounds of Formula I1 are used in combination with yellow, magenta, or cyan dye-forming couplers. Such couplers are known compounds and can be prepared by techniques known to those skilled in the art. Individual yellow couplers may be used singly or in combinations. Couplers that form yellow dyes upon reaction with oxidized color developing agent and which are useful in elements of the invention are described, e.g., in such representative patents and publications as: U.S. Pat. Nos. 2,875,057; 2,407,210; 3,265,506; 2,298,443; 3,048,194; 3,447,928 and "Farbkuppler-Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred acetanilide-based yellow couplers are represented by the following formulas:

YELLOW-1

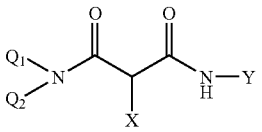

YELLOW-2

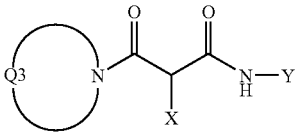

YELLOW-3

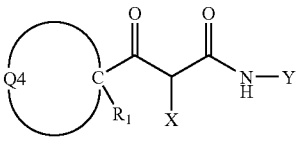

YELLOW-4

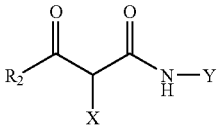

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-1 and YELLOW-4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are represented by YELLOW-4, wherein $R_2$ represents a tertiary alkyl group and Y represents an aryl group, and X represents an aryloxy or N-heterocyclic coupling-off group. The elements of the invention are particularly useful in combination with yellow couplers of the above formulas wherein X represents a nitrogen-containing heterocyclic coupling-off group.

Image dye forming couplers that form magenta dyes upon reaction with oxidized color developing agents may be included in elements of the invention, such as are described in representative patents and publications such as: U.S. Pat. Nos. 2,600,788; 2,369,489; 2,343,703; 2,311,082; 2,908,573; 3,062,653; 3,152,896; 3,519,429 and "Farbkuppler-Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Most preferred couplers are 2-aryl-1H-pyrazolo [1,5-b]-1,2,4-triazoles. Examples of 1H-pyrazolo [1,5-b]-1,2,4-triazoles can be found in European Patent Applications 176,804; 177,765; U.S. Pat. Nos. 4,659,652; 5,066,575; and 5,250,400.

Typical pyrazoloazole and pyrazolone couplers are represented by the following formulas:

MAGENTA-1

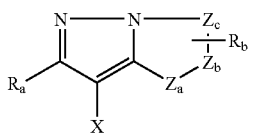

-continued

MAGENTA-2

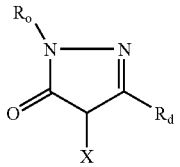

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$. Most preferred couplers are 2-aryl-1H-pyrazolo [1,5-b]-1,2,4-triazoles; wherein $Z_a$ and $Z_c$ are both N and $Z_b$ is the substituted methane group attached to $R_b$, which is a substituted aryl group.

Image dye forming couplers that form cyan dyes upon reaction with oxidized color developing agents may be included in elements of the invention, such as are described in representative patents and publications such as: U.S. Pat. Nos. 2,367,531; 2,423,730; 2,474,293; 2,772,162; 2,895,826; 3,002,836; 3,034,892; 3,041,236; 4,883,746 and "Farbkuppler-Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

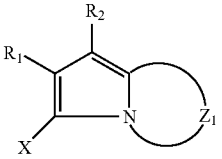

CYAN-2

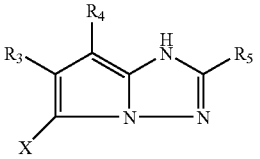

CYAN-3

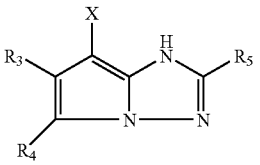

-continued

CYAN-4

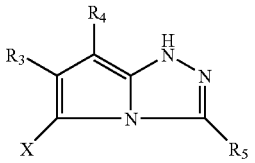

CYAN-5

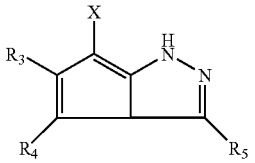

CYAN-6

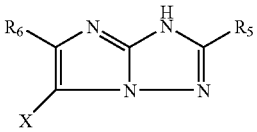

wherein $R_1$ and $R_5$ each represent a hydrogen or a substituent; $R_2$ represents a substituent; $R_3$ and $R_4$ each represent an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g.—N—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.,* 16, 1207 (1973); *J. Med. Chem.,* 20, 304 (1977); and J. A. Dean, *Lange's Handbook of Chemistry,* 12th Ed. (1979) (McGraw-Hill).

More preferable are cyan couplers of the following formulas:

CYAN-7

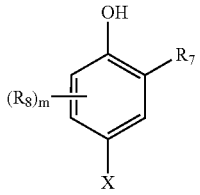

CYAN-8

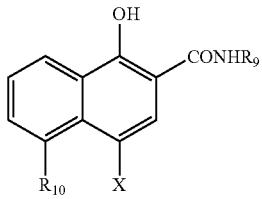

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent;

$R_{10}$ represents a hydrogen or a substituent (preferably a carbonamido or sulphonamido group); X represents a hydrogen or a coupling-off group; and m is from 1–3. Couplers of the structure CYAN-7 are most preferable for use in elements of the invention.

Representative couplers, which may be used in the elements of the invention, include, but are not limited to, the following yellow couplers YC1–YC25, magenta couplers MC1–MC30, and cyan couplers CC1–CC28:

YC1

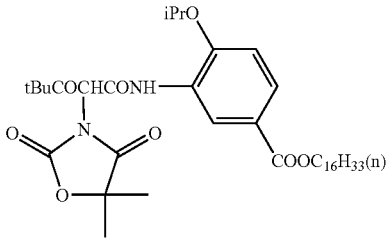

YC2

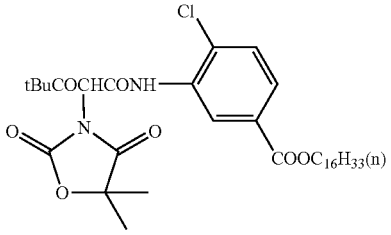

YC3

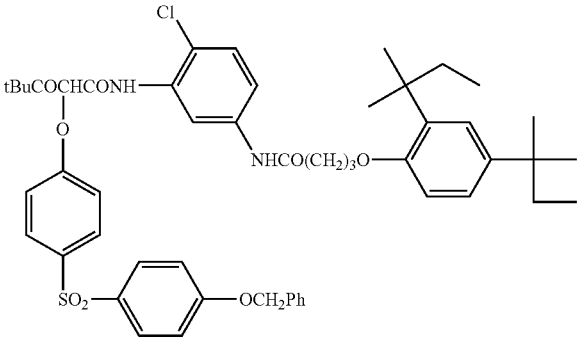

YC4

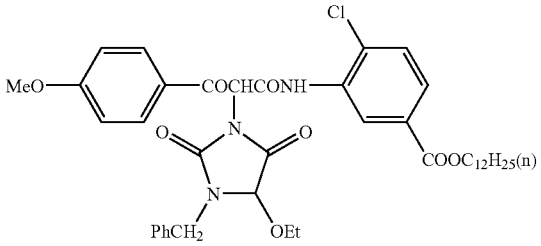

-continued

YC5

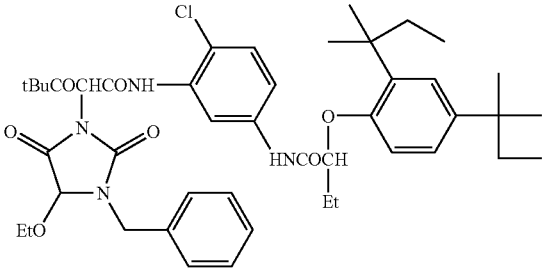

YV6

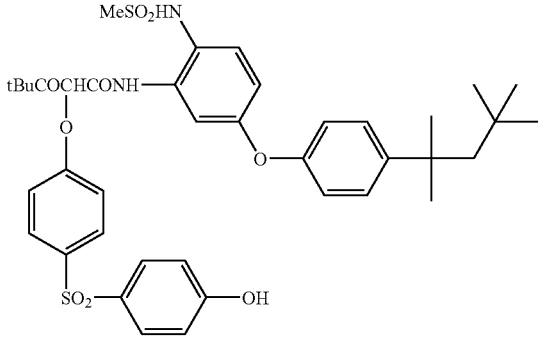

YC7

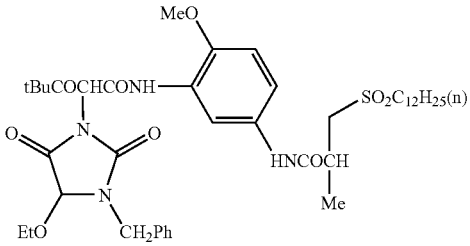

YC8

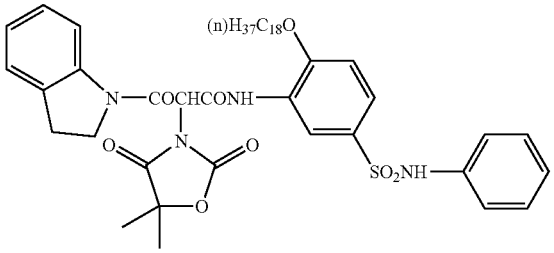

YC9

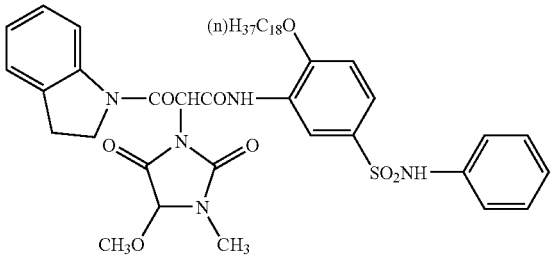

-continued
YC10
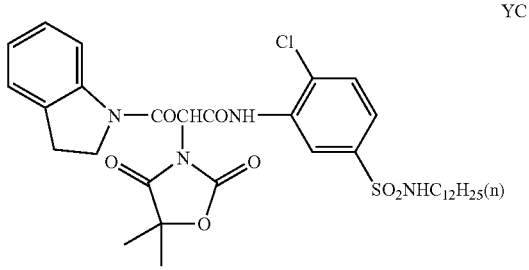
YC11
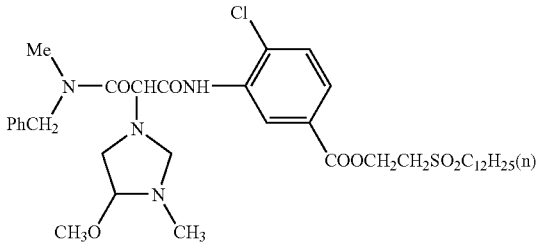
YC12
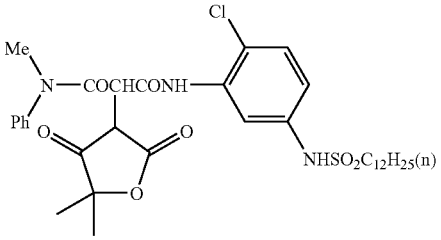
YC13
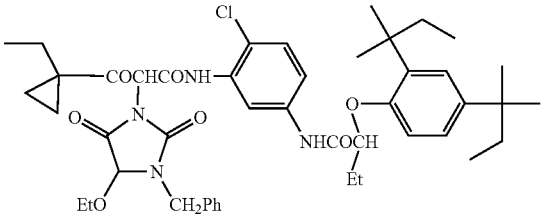
YC14
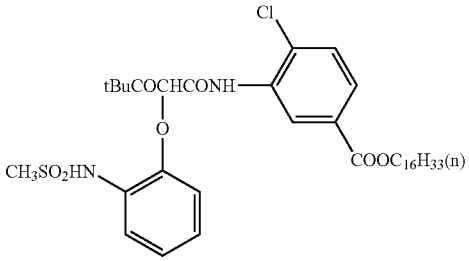
YC15
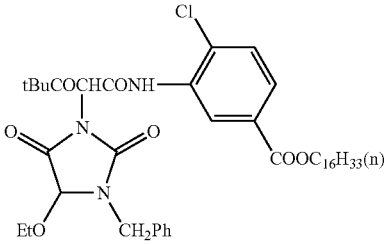
-continued
YC16
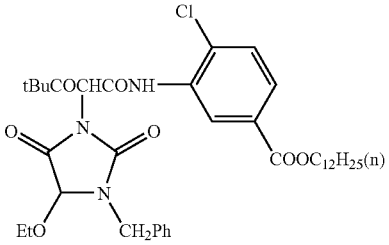
YC17
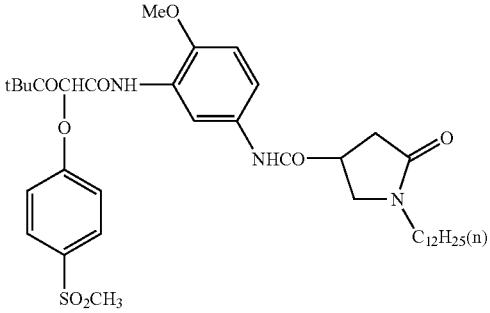
YC18
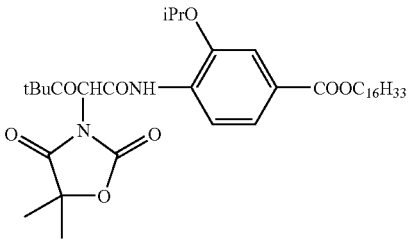
YC19
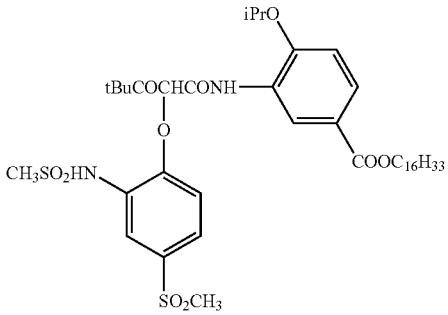
YC20
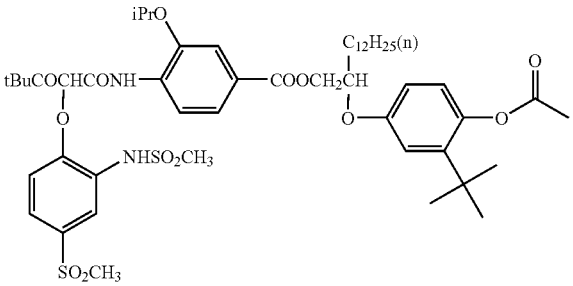

-continued
YC21
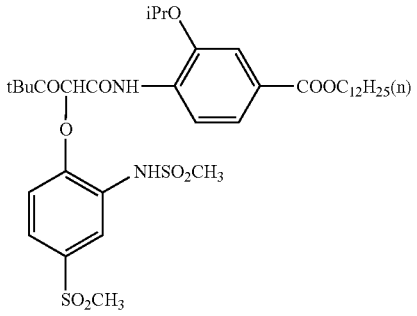
YC22
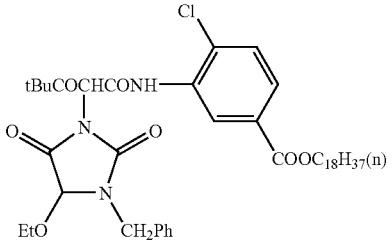
YC23
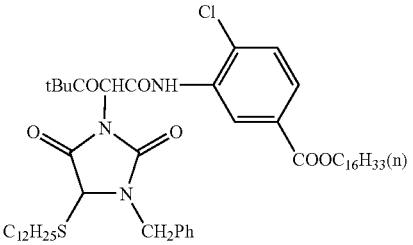
YC24
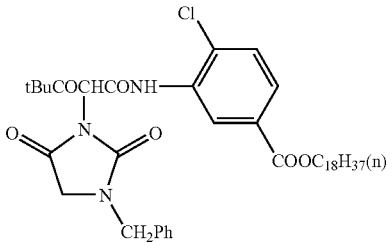
YC25
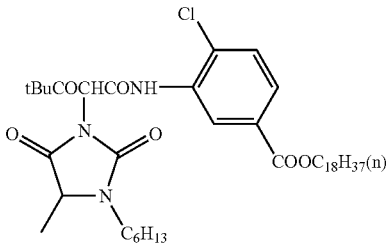
MC1
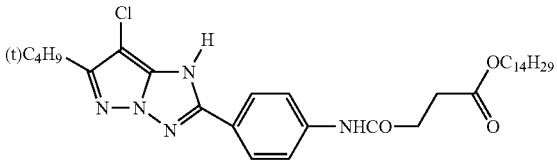
-continued
MC2
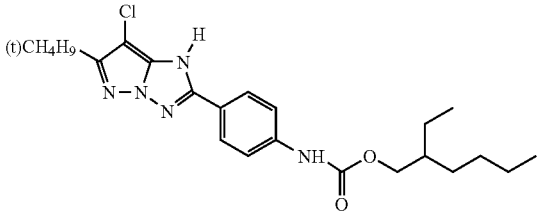
MC3
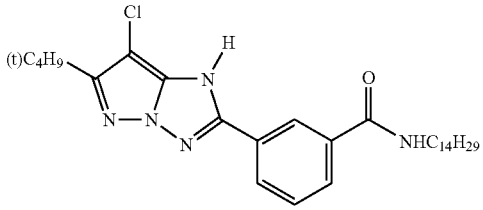
MC4
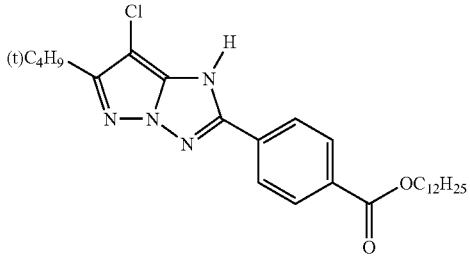
MC5
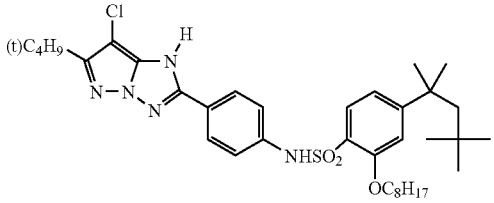
M6
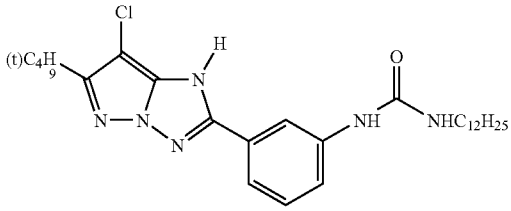
M7
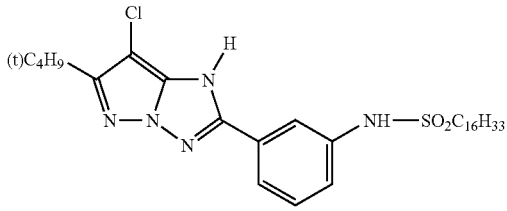
M8
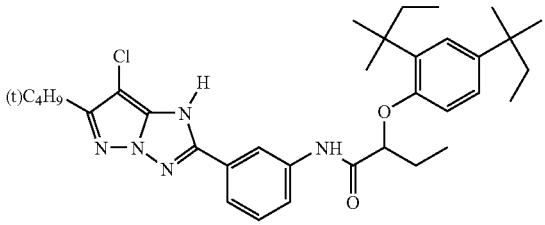

-continued
M9
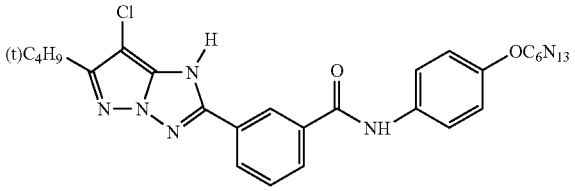
M10
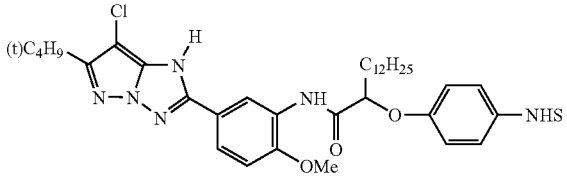
M11
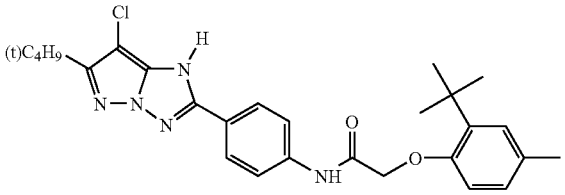
M12
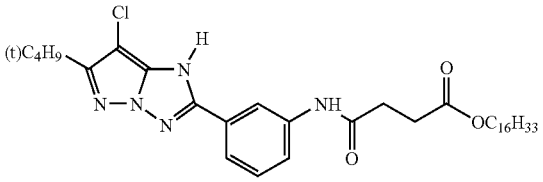
M13
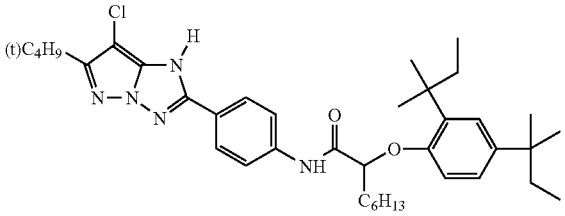
M14
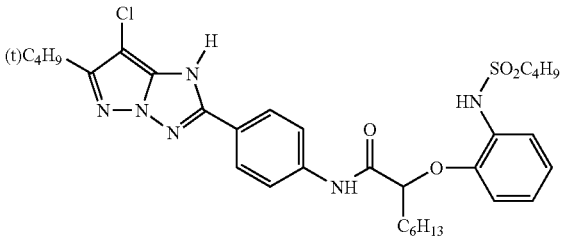
-continued
M15
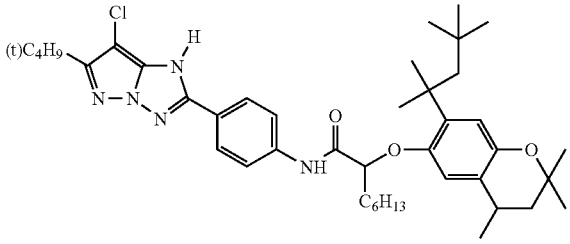
M16
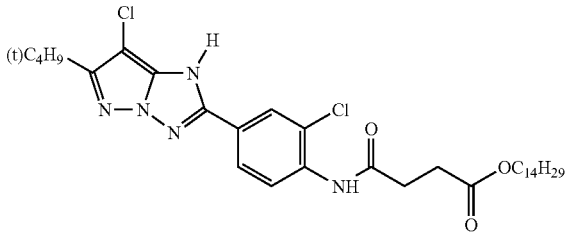
M17
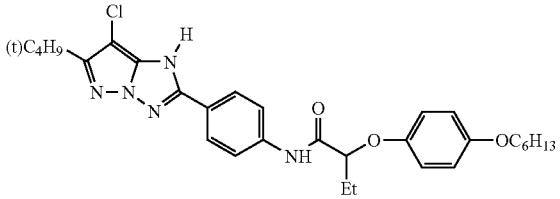
M18
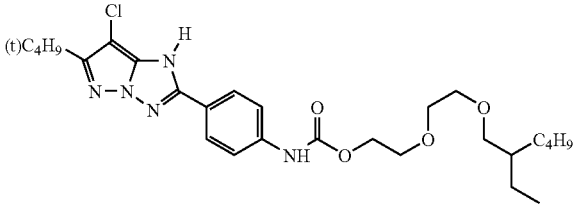
M19
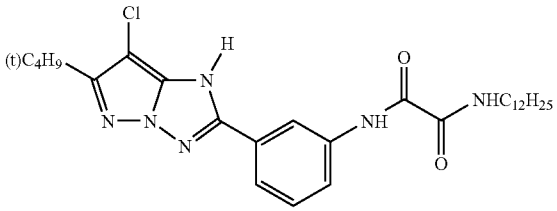
M20
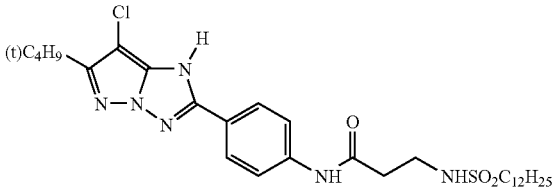

-continued
M21
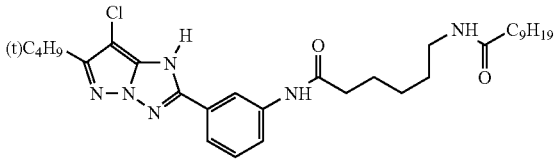
M22
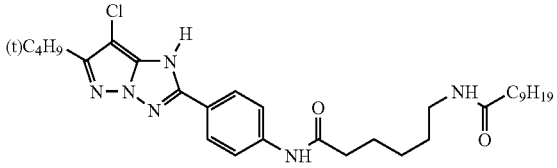
M23
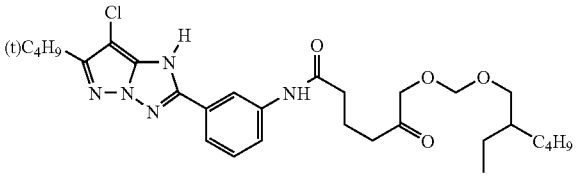
M24
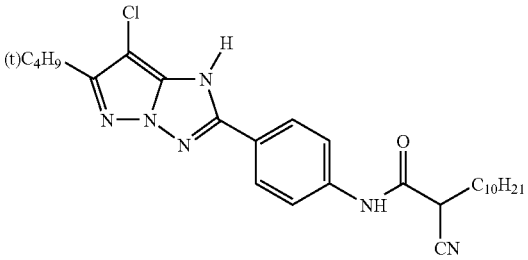
M25
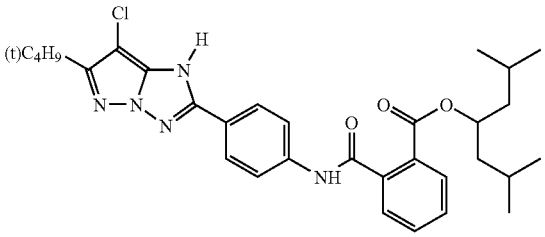
M26
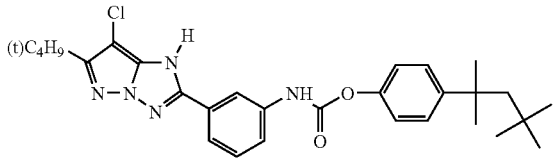
M27
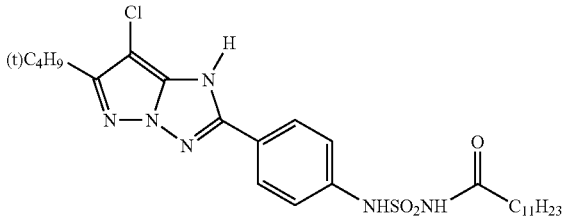
-continued
M28
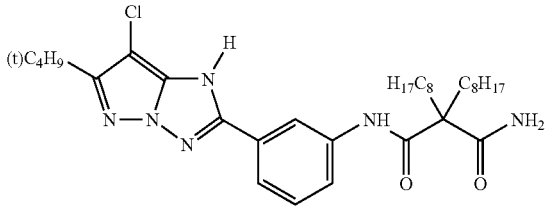
M28
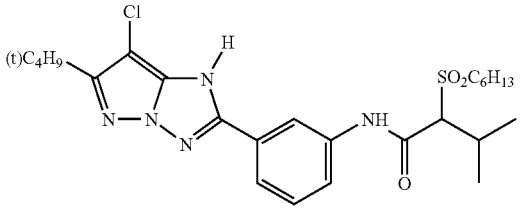
M30
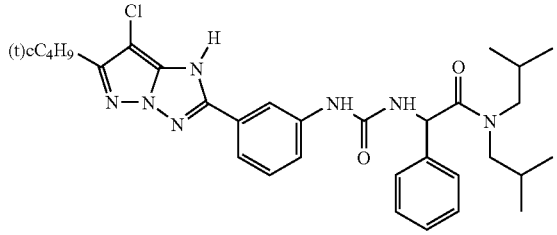
CC1
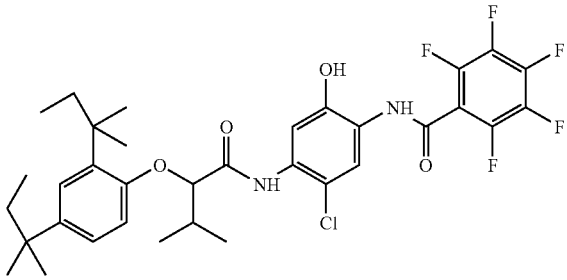
CC2
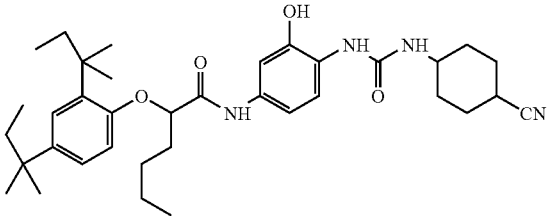
CC3
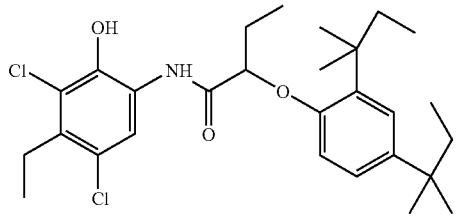

-continued
CC4
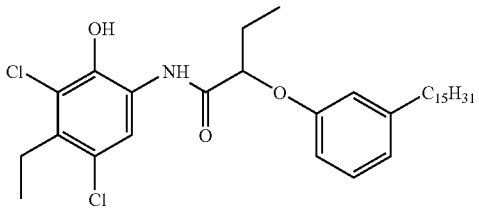
CC5
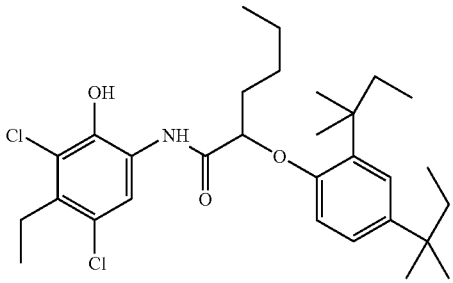
CC6
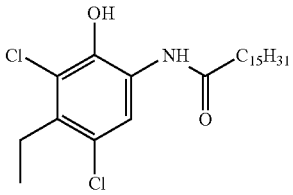
CC7
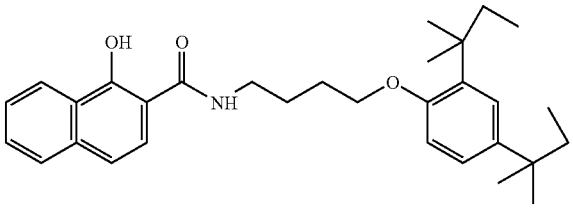
CC8
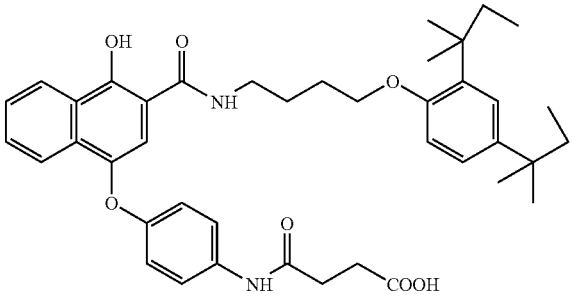
CC9
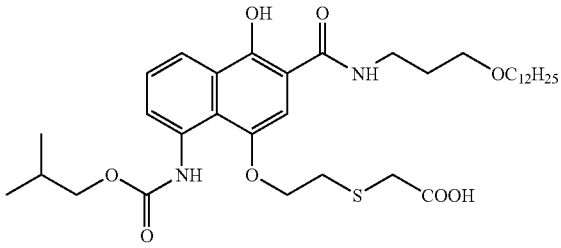
-continued
CC10
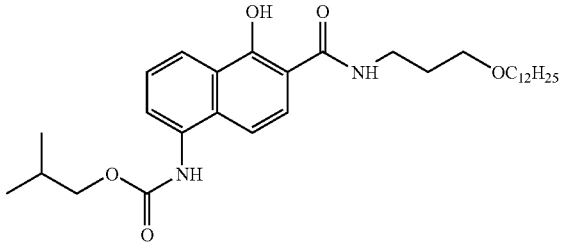
CC11
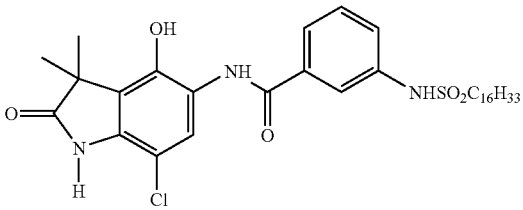
CC12
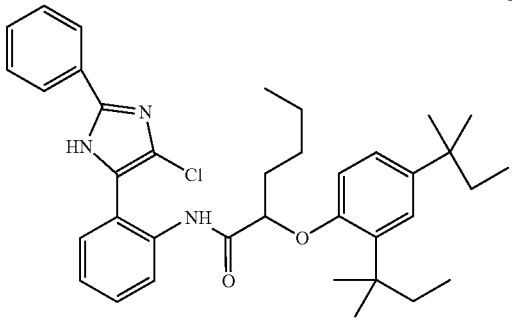
CC13
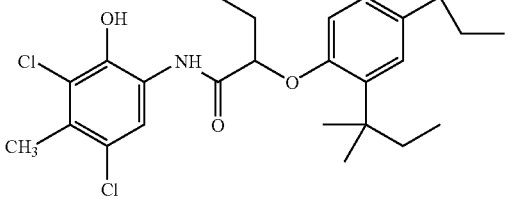
CC14
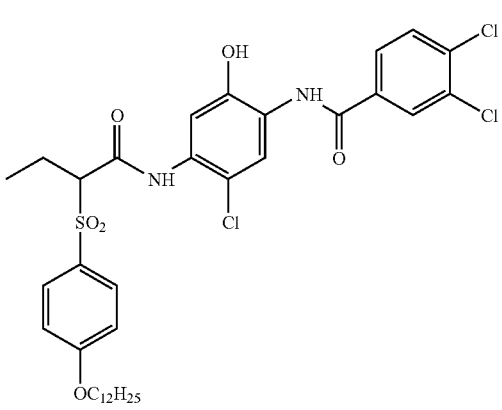

-continued
CC15
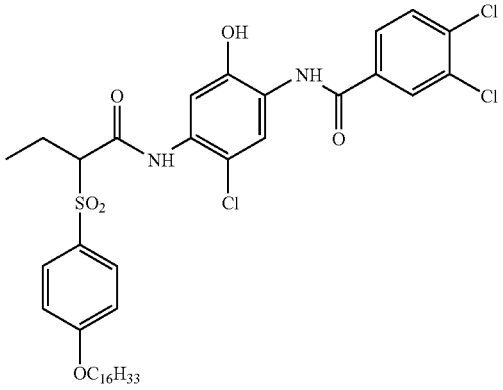
CC16
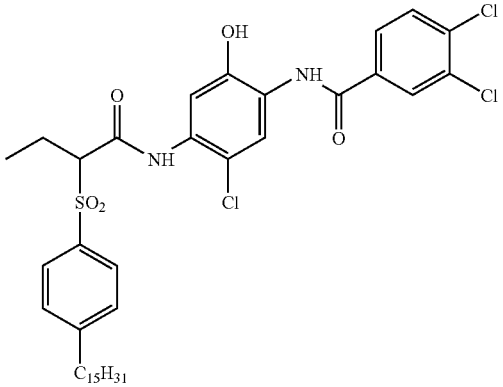
CC17
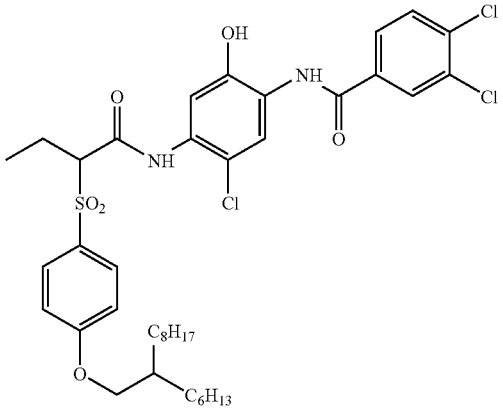
CC18
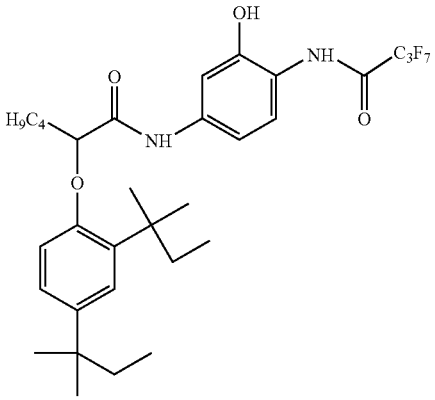
-continued
CC19
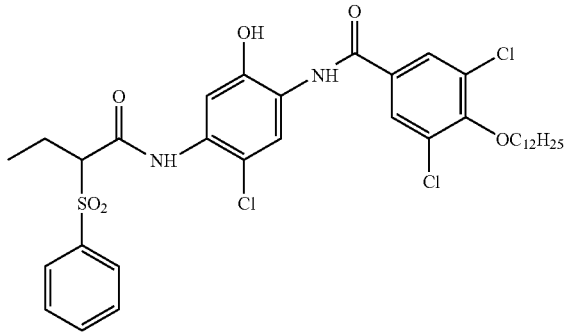
CC20
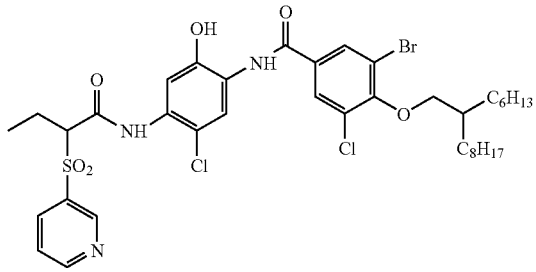
CC21
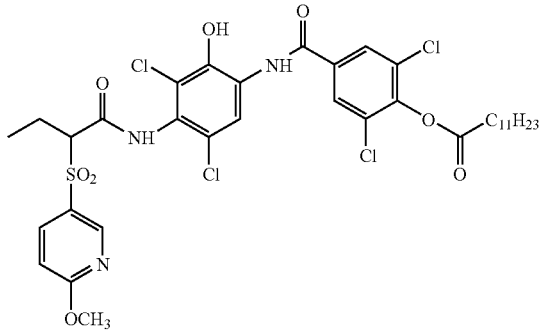
CC22
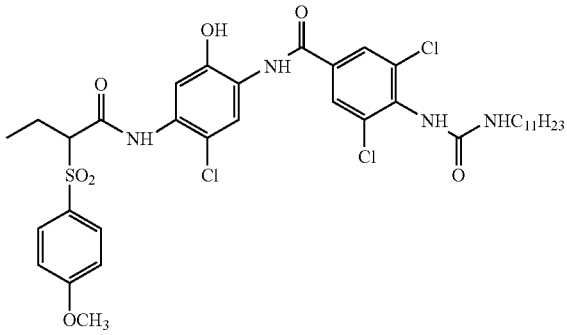

-continued

CC23

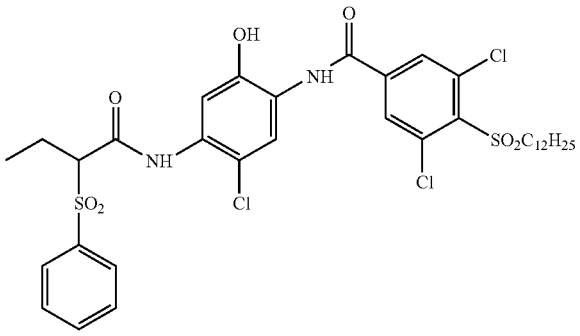

CC24

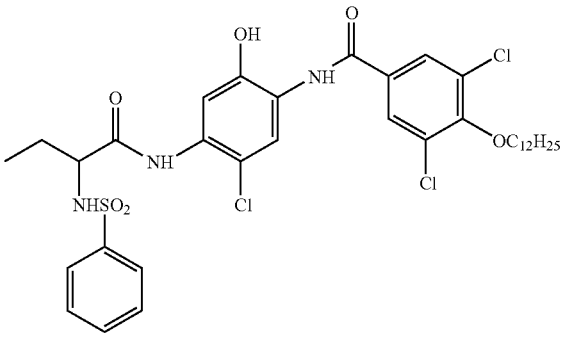

CC25

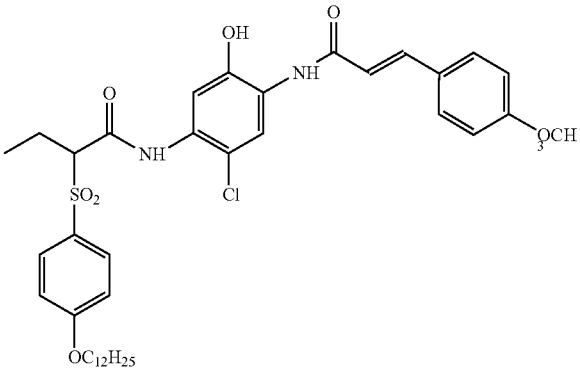

CC26

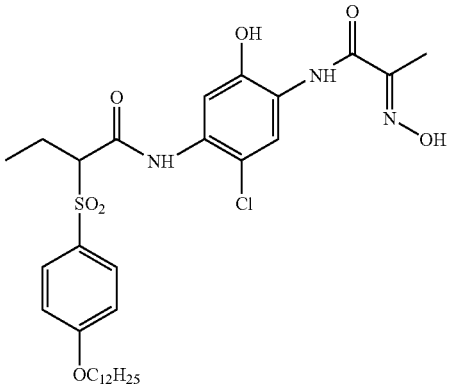

-continued

CC27

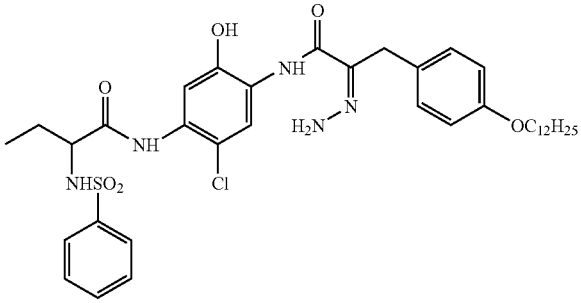

CC28

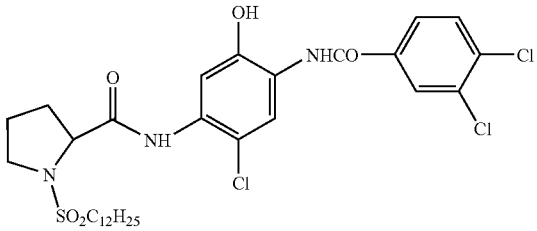

These specified stabilizers may be selected based on the dye layer of interest; for example, in the magenta layer, a sulfonamide, thiomorpholine dioxide or an electron rich aromatic ring system could be utilized, whereas in the yellow layer, a phenolic antioxidant is more appropriate, and in the cyan layer hydroxyphenyl benzotriazoles may be utilized.

The yellow, cyan and magenta dye forming couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Photographic elements of this invention can have the structures and components described in an article titled "Typical and Preferred Color Paper, Color Negative, and Color Reversal Photographic Elements and Processing," published in Research Disclosure, February 1995, Item 37038, pages 79–114. Research Disclosure is published by Kenneth Mason Publications, Ltd., Dudley Annex, 12a North Street, Emsworth, Hampshire P010 7DQ, ENGLAND. A typical multicolor photographic element of this invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support, which can be transparent or reflective. In a preferred embodiment, the invention is directed towards a photographic element that may be displayed for extended periods under illuminated conditions, such as a color paper photographic element, which comprises photographic layers coated on a reflective support. Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523.

While the order of the color sensitive layers in a photographic element in accordance with various embodiments of the invention can be varied, they will normally be red-sensitive, green-sensitive and blue-sensitive, in that order on a transparent support, (that is, blue sensitive furthest from the support) and the reverse order on a reflective support being typical. The element typically will have a total thickness (excluding the support) of from 5 to 30 microns.

This invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I." The Sections hereafter referred to are Sections of the Research Disclosure I.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers and supports in Sections XI and XIV, processing methods and agents in Sections XIX and XX, and exposure alternatives in Section XVI.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as developer inhibitor releasing compounds (DIR's).

The elements of the present invention may be employed to obtain reflection color prints as described in *Research Disclosure*, November 1979, Item 18716, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Patent Applications 83/09,959; 83/62,586; 90/072,629, 90/072,630; 90/072,632; 90/072,633; 90/072,634; 90/077,822; 90/078,229; 90/078,230; 90/079,336; 90/079,338; 90/079,690; 90/079,691; 90/080,487; 90/080,489; 90/080,490; 90/080,491; 90/080,492; 90/080,494; 90/085,928; 90/086,669; 90/086,670; 90/087,361; 90/087,362; 90/087,363; 90/087,364; 90/088,096; 90/088,097; 90/093,662; 90/093,663; 90/093,664; 90/093,665; 90/093,666; 90/093,668; 90/094,055; 90/094,056; 90/101,937; 90/103,409; 90/151,577.

The silver halide emulsion grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with an oxidizer and a solvent to remove silver and silver halide. In the case of processing a reversal color element, the element is first treated with a black and white developer (that is, a developer which does not form colored dyes with the coupler compounds) followed by a treatment to fog unexposed silver halide (usually chemical or light fogging), followed by treatment with a color developer. Preferred color developing agents are p-phenylenediamines. Especially preferred are: 4-amino-N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water-soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The photographic elements comprising stabilizers in accordance with this invention may be processed in amplification processes that use developer/amplifier solutions described in U.S. Pat. No. 5,324,624, for example. When processed in this way, the low volume, thin tank processing system and apparatus described in U.S. Pat. No. 5,436,118 preferably is employed.

SYNTHETIC EXAMPLE 1

Icc

To a solution of 4-(1,1-dioxido-4-thiomorpholinyl)-phenol (7.79 g; 34.3 mmol) and 12-bromo-1-dodecanol (10 g; 37.8 mmol) in acetonitrile (250 mL) was added cesium carbonate (16.8 g; 51.4 mmol) under nitrogen. The mixture was heated at reflux over night. The cooled mixture was poured into dilute cold HCl (1.5 L) and stirred for one half hour. The white solid was isolated by filtration, washed with water and air dried to afford 14.5 g of product. The solid was dissolved in hot acetone (100 mL) and poured into hexane (2 L). The solid was filtered, washed with hexane and air dried to give 12.2 g (86.5%) of pure product. Mp. 104–105° C.

The above alcohol (11.4 g; 27.7 mmol) was dissolved in dichloromethane (200 mL) and pyridine (2.2 g; 27.7 mmol) and a catalytic amount of DMAP were added. Para-methoxy cinnamoyl chloride (6 g; 30.5 mmol) was added in portions and the golden colored solution was stirred at RT over night. TLC (95:5; dichlormethane: acetone) revealed a small amount of starting alcohol; more cinnamoyl chloride (ca. 0.5 g) and pyridine (ca. 0.5 g) were added and the solution was allowed to stir for one additional day. The reaction mixture was poured into dilute cold HCl (1.5 L), the layers were separated and the aqueous layer was again extracted with dichloromethane. The organic layers were combined, dried ($Na_2SO_4$) and freed of solvent under vacuum to afford a cream colored solid (17.03 g). Chromatography on silica gel with 97:3; dichloromethane: ether, yielded 13.5 g (85%) of the desired product as a very light cream colored soild. Mp. 118.5–120° C. Mass spec. m/e=572 (P+1). NMR ($CDCl_3$); δ=1.25–1.85 (m, 20H), 3.15 (t, 4H), 3.7 (t, 4H), 3.85 (s, 3H), 3.95 (t, 2H), 4.2 (t, 2H), 6.35 (d, 1H), 6.9 (t, 6H), 7.5 (d, 2H), 7.65 (d, 1H).

EXAMPLE 2

Ie

A mixture of 2-ethylhexyl glycidyl ether (Aldrich; 30 g; 161 mmol), ethane sulfonamide (26.4 g; 241.5 mmol), potassium hydroxide (0.6 g; 10.7 mmol) and 18-crown-6 (0.6 g; 2.3 mmol) was heated at 100–115° C. in N-methylpyrrolidone for 1.5 hours. The reaction mixture was cooled and poured into ice water (1.5 L) containing HCl (5 mL). The solution was extracted twice with EtOAc; the extracts were combined and dried ($Na_2SO_4$). Solvent removal under vacuum afforded 47.4 g of an orange oil. Chromatography on silica gel with 6:4 heptane:EtOAc yielded the desired product as a pale yellow oil, 32.6 g (68.5%).

The above alcohol (8.58 g; 29 mmol) was dissolved in $CH_2Cl_2$ (100 mL). DIMAP (3.54 g; 29 mmol) was added followed by para-methoxy cinnamoyl chloride (6 g; 30.5 mmol) in portions. The reaction mixture was stirred at RT for 2 days and TLC (97:3 dichloromethane:ether) revealed remaining alcohol. More DIMAP (0.5 g) and cinnamoyl chloride (1 g) was added and the mixture allowed to stir an additional 7 days. The mixture was poured into dilute cold HCl (800 mL), the layers were separated and the organic layer extracted again with $CH_2Cl_2$. The organics were combined, dried ($Na_2SO_4$), and freed of solvent under vacuum to afford 13.3 g of golden colored oil. Chromatography on silica gel with 95:5; $CH_2Cl_2$:EtOAc, yielded the desired product as a pale yellow oil, 10.4 g (78.7%). FDMS m/z=456 (P+1). NMR ($CDCl_3$); δ=0.8–0.9 (m, 6H), 1.2–1.6 (m, 12H), 3.05 (q, 2H), 3.25–3.7 (m, 6H), 3.55 (s, 3H), 5 (t, 1H), 5.15 (t, 1H), 6.3 (d, 1H), 6.9 (d, 2H), 7.45 (d, 2H), 7.65 (d, 2H).

The following stabilizers/addenda are utilized in the demonstration of this patent as addenda or check molecules:

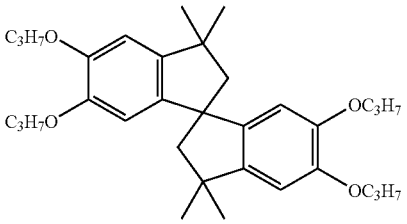

S1

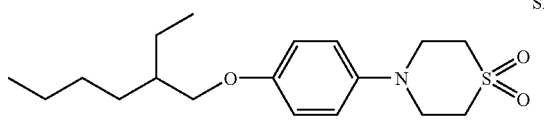

S2

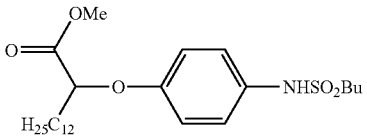

S3

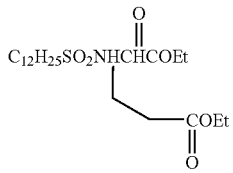

S4

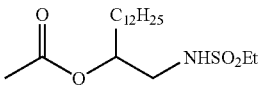

S5

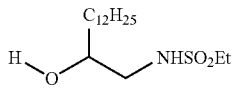

S6

-continued

S7

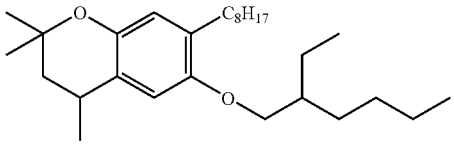

S8

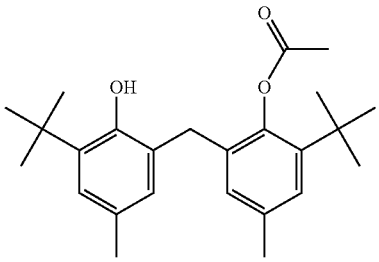

S9

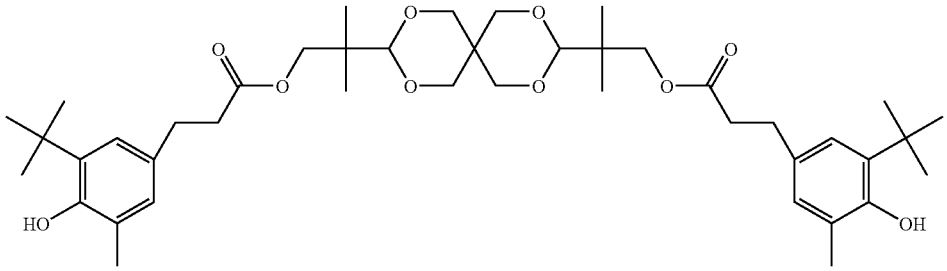

S10

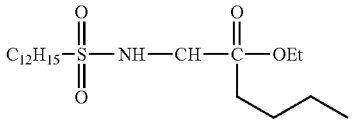

S11

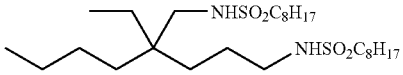

UV1

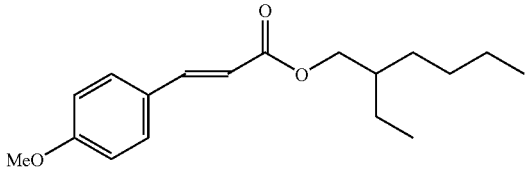

UV2

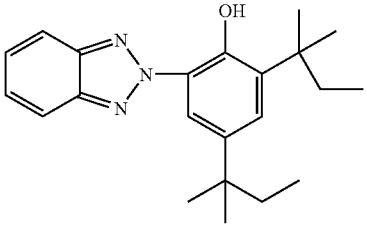

CS1

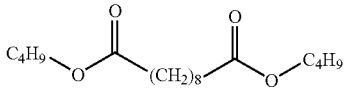

CS2

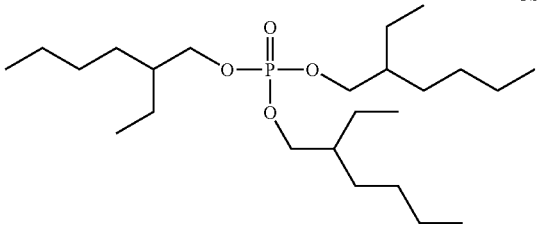

PHOTOGRAPHIC EXAMPLES

Photographic Example 1

In Example one, a coupler of the above structure MC1 is employed. Also, in addition to coupler solvents CS1 and CS2, stabilizer S2 (check) or Iu is employed. Coupler dispersions were prepared in accordance with conventional techniques by dissolving coupler MC1 in an equal weight of a 1:1 mixture of CS1 and CS2 with heating. Stabilizer S2 or Iu was added to the Magenta coupler oil phase (to provide indicated coated coverage), and the oil phase was dispersed in an aqueous phase containing gelatin and surfactant Alkanol-XC by homogenizing the mixture in a colloid mill. Each of the coupler dispersions was mixed with a green-sensitive cubic silver chloride photographic emulsion for coating on a resin-coated paper support, pre-coated with an unhardened gel pad. The coating structure is shown below.

| Coating Structure | |
|---|---|
| GEL SUPERCOAT | |
| Gelatin | 1.44 $g \cdot m^{-2}$ |
| Hardener* | 0.15 $g \cdot m^{-2}$ |
| Coating Surfactants | |
| UV absorber | 0.483 $g \cdot m^{-2}$ |
| Gelatin | 1.399 $g \cdot m^{-2}$ |
| Coating Surfactants | |
| PHOTOSENSITIVE LAYER | |
| Gelatin | 2.15 $g \cdot m^{-2}$ |
| Coupler | 0.145 $g \cdot m^{-2}$ |

-continued

| Coating Structure | |
|---|---|
| Coupler solvent | equal to weight of coupler |
| S2 (check) | 0.03088 $g \cdot m^{-2}$ |
| (or Iu | 0.054768 $g \cdot m^{-2}$) |
| Ag Halide emulsion | 0.12912 $g \cdot m^{-2}$ (as Ag) |
| GEL PAD | |
| Gelatin | 3.230 $g \cdot m^{-2}$ |
| Resin Coated Paper | |

*Hardener = bis (vinylsulphonylmethane)

Sample strips of the coatings were exposed to green light through a step tablet (density range 0–3, 0.15 increments) and developed in standard Kodak RA4 processing solutions before washing and drying. Sensitometric curves were generated for each processed strip. The image dye light stability was assessed using simulated daylight fading equipment incorporating a rotating Xenon arc light source surrounded by window glass, delivering an exposure intensity of 50 Klux at the sample plane. At the end of these tests, the densities of the sample strips were re-measured and compared with the initial curves. Status "A" blue density changes from an initial density value of 1.0 after 3 weeks treatment (3 wk HID) are recorded in the Tables below.

Photographic Example 2

This experiment examines the major claim by attaching a p-methoxycinnamate moiety to the known sulfonamide class stabilizers for magenta couplers (MC1). All light stability measurements were taken at 3 weeks HID (50 klux) and recorded as the percentage of dye density loss at a density of one. The check aryl sulfonamide S3 was coated along with invention, Ia, in a manor similar to that described above. Ia was prepared from S3 as shown below:

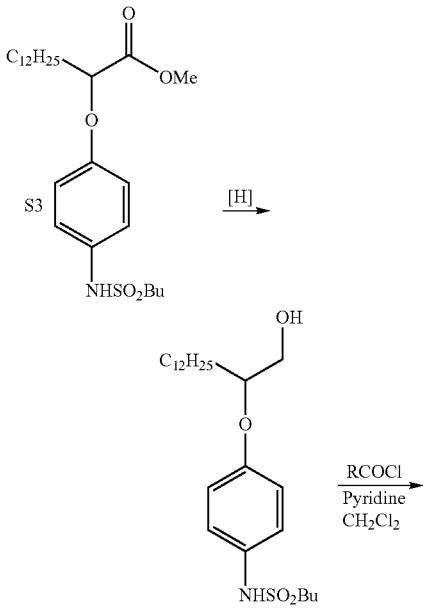

-continued

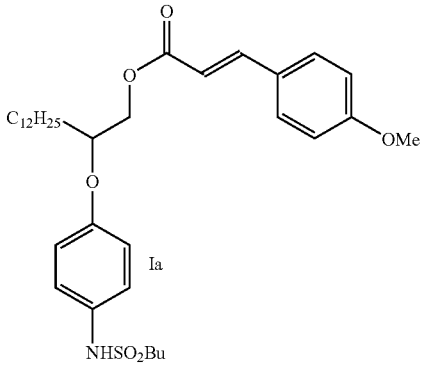

In a similar fashion the alkyl sulfonamide S4 was coated and compared to invention Id. As can be seen from table 1, the cinnamate containing sulfonamides, Ia and Id, lead to improved light stability over that of the simple sulfonamides S3 and S4.

TABLE 1

Comparison of aryl and alkyl sulfonamide stabilizers with invention stabilizers I. Magenta coupler-MC1.

| Stabilizer1 | Stabilizer2 | Dye loss 3 wk. (% loss from D = 1) |
|---|---|---|
| S2 | S3 | 9.6 (check) |
| S2 | Ia | 6.3 |
| S2 | S4 | 5.1 (check) |
| S2 | Id | 3.3 |

Photographic Example 3

It is important to demonstrate the synergistic properties, which arise from the linking of a stabilizer and a cinnamate moiety. In this interest, the cinnamate-sulfonamide Ic was taken apart into its separate units, S5/S6 and UV1 then recombined in equal molar amounts in the coating set with magenta coupler MC1. In table 2, entry 2, Ic has a better light stability position than all the possible combinations, entries 6, 7, and 8. In other words, the two portions, cinnamate and sulfonamide, when chemically linked, generate a molecule that affords better light stability than the sum of the parts (synergism). Table 2 also reports two additional cinnamate-sulfonamides, Ie and Ig, which are also improved over the S4 check (entry 5).

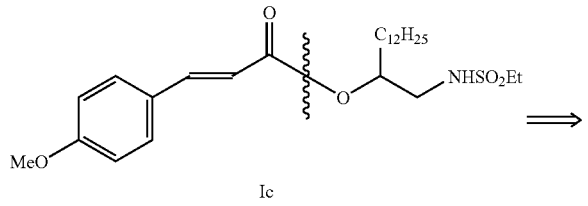

-continued

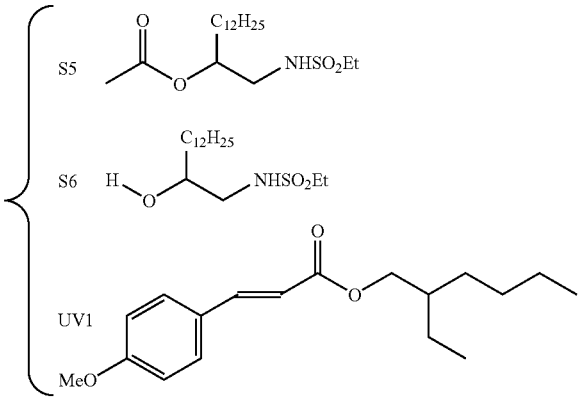

TABLE 2

Synergism with invention stabilizer Ic. Ic is broken apart into its components UV1 and S6. Magenta coupler-MC1.

| Stabilizer1 | Stabilizer2* | Stabilizer3* | Dye loss 3 wk. (% loss from D = 1) |
|---|---|---|---|
| 1. S1 | S6 | — | 11.6 |
| 2. S1 | Ic | — | 7.0 ⟸ |
| 3. S1 | S5 | — | 10.5 |
| 4. S1 | UV1 | — | 8.9 |
| 5. S1 | S4 | — | 11.8 |
| 6. S1 | UV1 | S5 | 8.1 |
| 7. S1 | UV1 | S6 | 8.8 |
| 8. S1 | UV1 | S4 | 8.0 |
| 9. S1 | Ig | — | 6.8 |
| 10. S1 | Ie | — | 7.6 |

*Stabilizers 2 and 3 coated at equal molar amounts.

Photographic Example 4

Synergism can also be demonstrated in the yellow layer utilizing the yellow coupler YC2 and the invention Iu. Iu links a thiomorpholine dioxide stabilizer and ap-methoxycinnamate. Table 3 shows the coatings of the individual stabilizer components, UV1 and S2, their mixture and stabilizer Iu. Iu affords better light stabilization than a mixture of the individual stabilizers. As shown, the UV portion (a cinnamate) of the invented molecule, Iu, is actually doing very little if anything to improve light stability (UV1, first entry). In fact, the mixture UV1/S2 is worse than S2 alone. This is indirect evidence that the cinnamate is actually acting as an energy quencher when linked to the stabilizer portion of the claimed molecule.

TABLE 3

Iu in Yellow Layer-Synergism (YC2).

| Coupler | Stab1 | Stab2 | Dye loss 3 wk. (% loss from D = 1) |
|---|---|---|---|
| YC2 | UV1 | — | 51.2 |
| YC2 | — | S2 | 30.4 |
| YC2 | UV1 | S2 | 32.6 |
| YC2 | — | Iu | 27.9 |

Photographic Example 5

To further demonstrate that the cinnamate (UV1) is not adding to light stability when coated alone, it was coated as the coupler solvent. In this case, if UV 1 were acting as a UV absorber, its greater concentration as a coupler solvent would increase it ability to absorb UV light and, therefore, increase light stability. As can be seen in table 4, UV1 is actually a worse solvent for light stability than the coupler solvents normally utilized (CS 1 and CS2).

TABLE 4

The utilization of the simple cinnamate UV1 as a coupler solvent. Magenta coupler is MC1.

| Stabilizer | Coupler Solvent | Dye loss 3 wk. (% loss from D = 1) |
|---|---|---|
| S2 | UV1 | 17.3 |
| S1 | UV1 | 17.3 |
| S2 | CS1/CS2 | 8.8 |

CS1

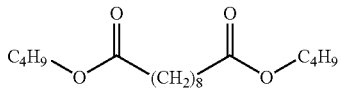

CS2

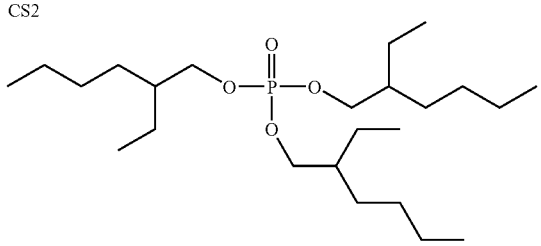

Photographic Example 6

In this example, invention Ib (cinnamate-sulfonamide) is compared to three different sulfonamide checks, S3, S4, and S10 in the presence of two different electron rich aromatic stabilizers, S1 and S7. In all cases, the new stabilizer Ib, is a more effective light stabilizer (table 5).

TABLE 5

Comparison of alkylsulfonamido cinnamate Ib with different sulfonamide checks and two electron rich aromatic systems (S1 and S7). Magenta coupler-MC1.

| Stabilizer1 EA | Stabilizer2 | Dye loss 3 wk. (% loss from D = 1) |
|---|---|---|
| S1 | S3 | 16.6 (check) |
| S1 | S4 | 10.5 (check) |
| S1 | S10 | 10.9 (check) |
| S1 | Ib | 7.2 |
| S7 | S3 | 18.7 (check) |
| S7 | S4 | 10.8 (check) |
| S7 | Ib | 8.4 |

Photographic Example 7

In this example, the p-methoxycinnamate moiety was attached to various electron rich aromatic systems, Im, Iq, and Is. These were coated and tested in a magenta single layer (MC1) with checks S1 and S7. As can be seen (table 6), the invention stabilizers afford more effective light stability compared to the non-cinnamate checks with various stabilizer combinations.

TABLE 6

Comparison of electron rich aromatic stabilizers with/without cinnamate linked moiety. Coupler-MC1.

| Stabilizer | Dye loss 3 wk. (% loss from D = 1) |
|---|---|
| S1 | 9.7 (Check) |
| S7 | 10.8 (Check) |
| Iq | 7.8 |
| Im | 6.7 |
| Is | 5.6 |

Photographic Example 8

A study of the structure activity relationship based around Iu reveals an optimum chain length (n) between the thiomorpholine dioxide moiety and the cinnamate in a single layer magenta coating (MC1). As can be seen in table 7, a chain length of 10 or more carbon atoms appears to afford a maximum light stability (Iu and Icc). This again speaks to the importance of the two portions of the molecule actually being linked together since activity varies dramatically depending on the chain length.

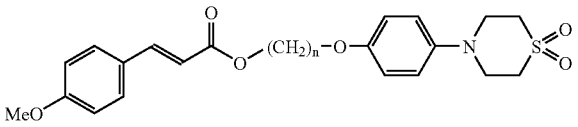

TABLE 7

Comparison of chain length between thiomorpholine dioxide and cinnamate moiety.

| Stabilizer | Chain Length | Dye loss 3 wk. (% loss from D = 1) |
|---|---|---|
| | Coating 1 | |
| S2 | — | 7.1 (check) |
| Iu | C-10 | 5.2 |
| Iz | C-4 | 26.2 |
| It | C-2 | 6.8 (with $NHSO_2R$) |
| | Coating 2 | |
| S2 | — | 9.1 (check) |
| Icc | C-12 | 6.5 |
| Iz | C-4 | 31.5 |
| Iaa | C-6 | 15.1 |

Photographic Example 9

Additional magenta couplers were tested with the inventions Ib and Icc. Table 8 and 9 reveal that in both cases either Ib or Icc are again more effective light stabilizers than the non-cinnamate checks (S4 or S2).

TABLE 8

The effects of invention Ib on other magneta dye couplers.

| Coupler | Stabilizer1 | Stabilizer2 | Dye loss 3 wk. (% loss from D = 1) |
|---|---|---|---|
| MC31 | S1 | S4 | 11.5 (check) |
| MC31 | S1 | Ib | 7.0 |
| MC8 | S1 | S4 | 8.7 (check) |
| MC8 | S1 | Ib | 7.1 |

TABLE 9

Comparison of additional magenta couplers with check S2 and invention Icc.

| Coupler | Stabilizer | Dye loss 3 wk. (% loss from D = 1) |
|---|---|---|
| MC8 | S2 | 8.2 |
| MC30 | S2 | 10.2 |
| MC19 | S2 | 9.8 |
| MC25 | S2 | 8.4 |
| MC27 | S2 | 27.7 |
| MC26 | S2 | 9.8 |
| MC8 | Icc | 6.8 |
| MC30 | Icc | 8.3 |
| MC19 | Icc | 7.8 |
| MC25 | Icc | 6.6 |
| MC27 | Icc | 25.3 |
| MC26 | Icc | 8.3 |

Photographic Example 10

The stabilizer mixture, S2, S8 and S9 was reported in U.S. Pat. No. 6,555,306 (B 1) in connection with a new class of bis-amide stabilizing yellow coupler solvents. The effects of changing from CS3 (Tributyl citrate) to the bis-amide solvent CS4 utilizing invention Ig in a single yellow layer coating are shown in table 10. As can be seen, when the conventional stabilizer S9 (entry 1) is replaced with Ig (entry 2), an improvement in light stability is realized. When this set of stabilizers (entry 3) is now coated in the newer coupler solvent CS4, an additional increase in light stability is observed. This data shows that the invention stabilizer Ig also performs as expected in the newer bis-amide coupler solvents, CS4.

TABLE 10

Ig in Yellow Layer (YC2). Effect of coupler solvent and stabilizer mixtures.

| Coupler | Stab 1 | Stab 2 | Stab 3 | Solvent | Dye loss 3 wk. (% loss from D = 1) |
|---|---|---|---|---|---|
| 1. YC2 | S8 | S2 | S9 | CS3 | 22.8 |
| 2. YC2 | S8 | S2 | Ig | CS3 | 17.4 |
| 3. YC2 | S8 | S2 | Ig | CS4 | 11.3 |
| 4. YC2 | — | — | Ig | CS4 | 18.6 |
| 5. YC2 | S8 | — | Ig | CS4 | 13.9 |

TABLE 10-continued

Ig in Yellow Layer (YC2). Effect of coupler solvent and stabilizer mixtures.

| Coupler | Stab 1 | Stab 2 | Stab 3 | Solvent | Dye loss 3 wk. (% loss from D = 1) |
|---|---|---|---|---|---|
| CS3 | 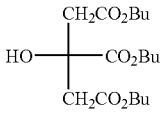 | | | | |
| CS4 | 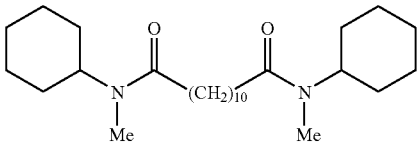 | | | | |

Photographic Example 11

In this experiment, a conventional benzotriazole UV absorber containing a cinnamate moiety was coated within the cyan layer. As can be seen from table 11, the UV absorber containing the cinnamate (Ikk) moiety increases light stability of the cyan dye layer when compared to the same benzotriazole containing a simple ester, UV3.

TABLE 11

Comparison of cinnamate (Ikk) vs non-cinnamate containing benzotriazole UV absorber for the cyan layer. Cyan coupler-CC14, coupler solvent-CS1.

| Stabilizer | Dye loss 3 wk. (% loss from D = 1) |
|---|---|
| Ikk | 19.7 |
| UV3 | 26.2 |

Ikk

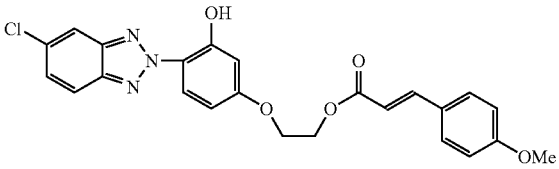

UV3

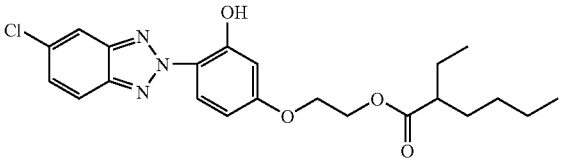

Photographic Example 12

This example compares the effects of different substituted aromatics rings on the cinnamate (Ie and Imm) of the same sulfonamide stabilizer. Table 12 reveals that Imm with three methoxy groups on the aromatic ring is even better than the p-methoxy cinnamate Ie. Again both Ie and Imm are better than the non-cinnamate containing sulfonamide S4, which actually does not improve light stability over S2 alone.

TABLE 12

Comparison of different substitued aromatic rings on the cinnamate sulfonamide (Ie and Imm). Coupler is MC1.

| Stabilizer1 | Stabilizer2 | Dye loss 3 wk. (% loss from D = 1) |
|---|---|---|
| S2 | — | 8.8 check |
| S2 | S4 | 8.4 check |
| S2 | Ie | 6.9 |
| S2 | Imm | 4.9 |

The above experiments demonstrate how a cinnamate moiety can be utilized to increase the light stability of dye images in all three dye layers, yellow, magenta, and cyan.

The invention has been described by reference to preferred embodiment, but it will be understood changes can be made to the embodiments specifically described herein within the spirit and scope of the invention.

The invention claimed is:

1. A photographic element comprising a silver halide emulsion layer having associated therewith a dye forming coupler and a compound of the following Formula I1:

(I1)

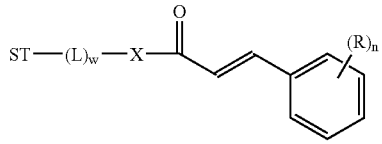

wherein

L is a linking moiety;

X is a heteroatom group selected from O, S, or NR' where R' is H or a substituent;

w is 0 or 1;

R is hydrogen or a substituent group;

n is an integer from 0 to 5; and

ST represents a stabilizer selected from the group consisting of:

A. a thiomorpholine dioxide;

B. a dialkoxy aromatic group linked through a phenolic oxygen;

C. a dialkoxy aromatic group linked through the aromatic ring;

D. a sulfonamido group;

E. a hydroxyphenyl benzotriazole group; and

F. a phenolic group.

2. The element of claim 1 wherein ST is a thiomorpholine dioxide and Formula (I1) is represented by Formula A:

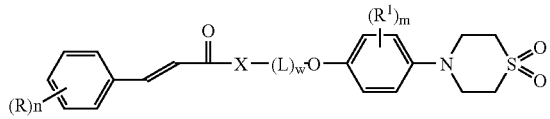

wherein $R^1$ is a substituent as defined for R;

n is an integer between 0 and 5;

m is an integer between 0 and 4;

provided that if n and m are 2 through 4 the R groups may be the same or different and provided that two R or two $R^1$ groups may form a substituted or unsubstituted ring.

3. The element of claim 1 wherein L is represented by the formula below:

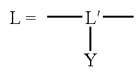

wherein Y is represented by a formula selected from the group consisting of:

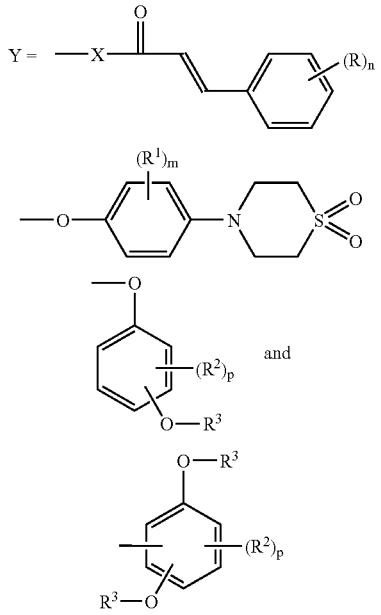

wherein L', is any molecular group that would chemically link the various parts of the molecule; $R^2$ thru $R^4$ are substituents as for $R^1$; and p is an integer from 0 to 4.

4. The element of claim 1 wherein ST is a dialkoxyaromatic group linked by an oxy group to the ring and Formula (I1) is, represented by Formula B:

(B)

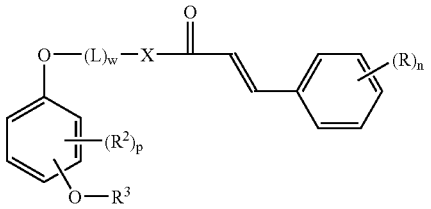

wherein $R^2$ and $R^3$ are substituents as defined for R provided two $R^2$ groups or one $R^2$ and one $R^3$ together may form a substituted or unsubstituted ring;

p is an integer from 0 to 4, provided that if p is 2 or larger, the respective R groups may be the same or different.

5. The element of claim 1 wherein ST is a dialkoxyaromatic group linked by a ring carbon and Formula (I1) is represented by Formula C:

(C)

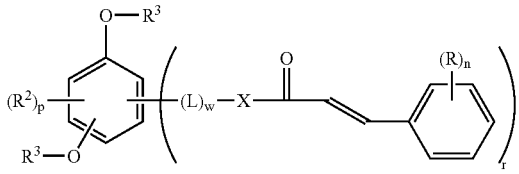

wherein $R^2$ and $R^3$ are substituents groups;

p is an integer from 0 to 3;

r is an integer from 1 to 4, provided the total of p and r is no larger than 4.

6. The element of claim 1 wherein ST is a sulfonamide group and Formula (I1) is represented by Formula D:

(D)

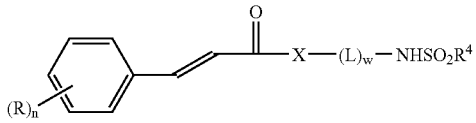

wherein $R^4$ is a substituted or unsubstituted alkyl or cycloalkyl group.

7. The element of claim 1 wherein ST is a hydroxyphenyl benzotriazole group and Formula (I1) is represented by Formula E:

(E)

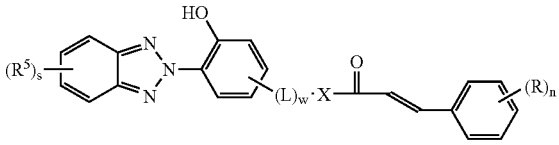

wherein $R^5$ is a substituent as defined for R; and s is an integer between 0 and 4;

provided that if s is 2 through 4, the $R^5$ groups may be the same or different, and provided that two $R^5$ groups together may form a substituted or unsubstituted ring.

8. The element of claim 1 wherein ST is a phenolic group and Formula (I1) is represented by Formula F:

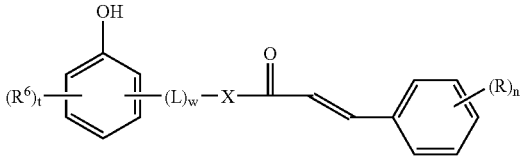

wherein $R^6$ is a substituent as defined above; and t is an integer between 0 and 4; provided that if t is 2 through 4, the $R^6$ groups may be the same or different and provided that two $R^6$ groups together may form a substituted or unsubstituted ring.

9. The element according to claim 1 wherein the silver halide emulsion layer further has associated therewith an aryl or alkyl sulfonamide stabilizer compound outside of Formula I1.

10. The element according to claim 1 wherein the silver halide emulsion layer further has associated therewith a thiomorpholine dioxide sabilizer compound outside of formula I1.

11. The element according to claim 1 wherein the silver halide emulsion layer further has associated therewith a phenolic stabilizer compound outside of Formula I1.

12. An element according to claim 1 wherein the silver halide emulsion layer further has associated therewith an electron rich aromatic stabilizer outside of formula I1.

13. An element according to claim 1, wherein the silver halide emulsion layer further has associated therewith a dye-forming coupler selected from a yellow, magenta and a cyan coupler.

14. An element according to claim 13, wherein the dye-forming coupler comprises an acetanilide-based yellow dye-forming coupler.

15. An element according to claim 14, wherein the yellow coupler is of the formula

YELLOW-1

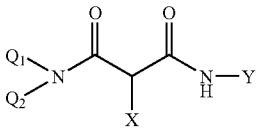

YELLOW-2

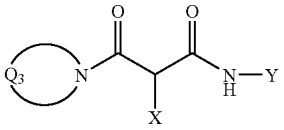

YELLOW-3

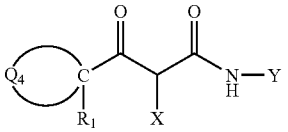

or

YELLOW-4

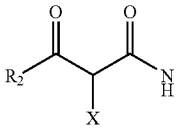

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring.

16. An element according to claim 15, wherein the yellow coupler is of the formula YELLOW-4 where $R_2$ represents an aryl or alkyl group and Y represents an aryl group.

17. An element according to claim 16, wherein $R_2$ represents a tertiary alkyl group.

18. An element according to claim 13, wherein the dye-forming coupler comprises a 2-aryl-1H-pyrazolo [1,5-b]-1,2,4-triazole magenta dye-forming coupler of formula MAGENTA-1:

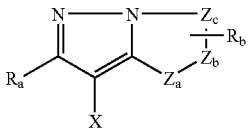

wherein X is hydrogen or a coupling-off group; and $Z_a$ and $Z_c$ are independently a, =N— or —NH—, provided that one of either the $Z_a$—$Z_b$ bond or the $Z_b$—$Z_c$ bond is a double bond and the other is a single bond, and $Z_b$ represents a methine group connected to the group $R_b$, which is a substituted aryl group.

19. An element according to claim 13, wherein the dye-forming coupler comprises a phenolic cyan dye-forming coupler of formula CYAN-7:

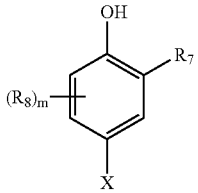

wherein $R_7$ represents a substituent (preferably a carbamoyl, ureido, or carbonamido group); $R_8$ represents a substituent (preferably individually selected from halogen, alkyl, and carbonamido groups; X represents a hydrogen or a coupling-off group; and m is from 1–3.

20. An element according to claim 13, comprising a color paper photographic element, which comprises a reflective support.

21. An element according to claim 13, wherein the yellow coupler is dissolved in an alkylidene bis-amide coupler solvent.

* * * * *